US010185276B2

(12) United States Patent
Hirakata et al.

(10) Patent No.: US 10,185,276 B2
(45) Date of Patent: Jan. 22, 2019

(54) IMAGE FORMING APPARATUS HAVING AN INTERCEPTOR TO INTERCEPT TONER PARTICLES

(71) Applicant: FUJI XEROX CO., LTD., Tokyo (JP)

(72) Inventors: Masaki Hirakata, Kanagawa (JP); Takashi Imai, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/453,488

(22) Filed: Mar. 8, 2017

(65) Prior Publication Data

US 2018/0067443 A1 Mar. 8, 2018

(30) Foreign Application Priority Data

Sep. 2, 2016 (JP) ..... 2016-171983

(51) Int. Cl.
*G03G 21/00* (2006.01)
*G03G 15/00* (2006.01)

(52) U.S. Cl.
CPC ..... *G03G 15/75* (2013.01); *G03G 21/0005* (2013.01); *G03G 21/007* (2013.01); *G03G 21/0011* (2013.01); *G03G 21/0076* (2013.01); *G03G 2221/001* (2013.01)

(58) Field of Classification Search
CPC ..... G03G 15/75; G03G 21/0005; G03G 21/0011; G03G 21/007; G03G 21/0076; G03G 2221/001; G03G 2215/0125; G03G 2215/0129; G03G 2215/0132
See application file for complete search history.

(56) References Cited

U.S. PATENT DOCUMENTS

| | | | | |
|---|---|---|---|---|
| 4,848,141 | A | 7/1989 | Oliver et al. | |
| 5,298,617 | A | 3/1994 | Nukada et al. | |
| 5,302,479 | A | 4/1994 | Daimon et al. | |
| 5,459,004 | A | 10/1995 | Katsumi et al. | |
| 2004/0197122 | A1* | 10/2004 | Nakano | G03G 21/0005 399/350 |

(Continued)

FOREIGN PATENT DOCUMENTS

| | | | | |
|---|---|---|---|---|
| DE | 3201529 | A * | 11/1982 | G03G 21/0047 |
| EP | 0 710 893 | A1 | 5/1996 | |

(Continued)

*Primary Examiner* — David M. Gray
*Assistant Examiner* — Laura Roth
(74) *Attorney, Agent, or Firm* — Sughrue Mion, PLLC

(57) ABSTRACT

An image forming apparatus includes an electrophotographic photoreceptor, a charging device, an electrostatic latent image forming device, a developing device, a transfer device, and a cleaning device, and further includes an intercepting device that includes an intercepting member separated from the electrophotographic photoreceptor by a gap so that a distance from the surface of the electrophotographic photoreceptor to the intercepting member is about 0.3 to 0.9 (inclusive) times a volume-average particle size of toner particles. The intercepting member is used to intercept residual toner particles at a position downstream of the transfer device and upstream of the cleaning device in a rotation direction of the electrophotographic photoreceptor, the residual toner particles remaining on the surface of the electrophotographic photoreceptor.

8 Claims, 8 Drawing Sheets

(56) References Cited

U.S. PATENT DOCUMENTS

| | | | | |
|---|---|---|---|---|
| 2009/0052934 | A1 | 2/2009 | Miyaji et al. | |
| 2010/0239309 | A1 | 9/2010 | Tanaka et al. | |
| 2010/0329721 | A1* | 12/2010 | Kobayashi | G03G 15/752 399/71 |
| 2011/0188882 | A1* | 8/2011 | Kato | G03G 21/20 399/102 |
| 2014/0295334 | A1* | 10/2014 | Hirakata | G03G 5/0436 430/56 |

FOREIGN PATENT DOCUMENTS

| | | | | | |
|---|---|---|---|---|---|
| JP | 62121480 | A | * | 6/1987 | G03G 21/0011 |
| JP | 62127783 | A | * | 6/1987 | |
| JP | 4-189873 | A | | 7/1992 | |
| JP | 05-098181 | A | | 4/1993 | |
| JP | 05-140472 | A | | 6/1993 | |
| JP | 05-140473 | A | | 6/1993 | |
| JP | 5-263007 | A | | 10/1993 | |
| JP | 5-279591 | A | | 10/1993 | |
| JP | 8-176293 | A | | 7/1996 | |
| JP | 08-208820 | A | | 8/1996 | |
| JP | 2004-078147 | A | | 3/2004 | |
| JP | 2005-181992 | A | | 7/2005 | |
| JP | 2009-69810 | A | | 4/2009 | |
| JP | 2010-244037 | A | | 10/2010 | |
| JP | 2012-155282 | A | | 8/2012 | |

* cited by examiner

IMAGE FORMING APPARATUS HAVING AN INTERCEPTOR TO INTERCEPT TONER PARTICLES

CROSS-REFERENCE TO RELATED APPLICATIONS

This application is based on and claims priority under 35 USC 119 from Japanese Patent Application No. 2016-171983 filed Sep. 2, 2016.

BACKGROUND

Technical Field

The present invention relates to an image forming apparatus.

SUMMARY

According to an aspect of the invention, there is provided an image forming apparatus that includes an electrophotographic photoreceptor that includes a conductive substrate, a photosensitive layer on the conductive substrate, and an inorganic protective layer on the photosensitive layer, the inorganic protective layer constituting an outermost surface layer; a charging device that charges a surface of the electrophotographic photoreceptor; an electrostatic latent image forming device that forms an electrostatic latent image on the charged surface of the electrophotographic photoreceptor; a developing device that houses a developer containing a toner having toner particles and develops the electrostatic latent image on the surface of the electrophotographic photoreceptor by using the developer so as to form a toner image; a transfer device that transfers the toner image onto a surface of a recording medium; a cleaning device that includes a cleaning blade and removes residual matters on the surface of the electrophotographic photoreceptor by bringing the cleaning blade into contact with the surface of the electrophotographic photoreceptor; and an intercepting device that includes an intercepting member separated from the electrophotographic photoreceptor by a gap so that a distance from the surface of the electrophotographic photoreceptor to the intercepting member is 0.3 to 0.9 or about 0.3 to 0.9 (inclusive) times a volume-average particle size of the toner particles, the intercepting member being used to intercept residual toner particles at a position downstream of the transfer device and upstream of the cleaning device in a rotation direction of the electrophotographic photoreceptor, the residual toner particles remaining on the surface of the electrophotographic photoreceptor.

BRIEF DESCRIPTION OF THE DRAWINGS

Exemplary embodiments of the present invention will be described in detail based on the following figures, wherein.

DETAILED DESCRIPTION

Figure 1:
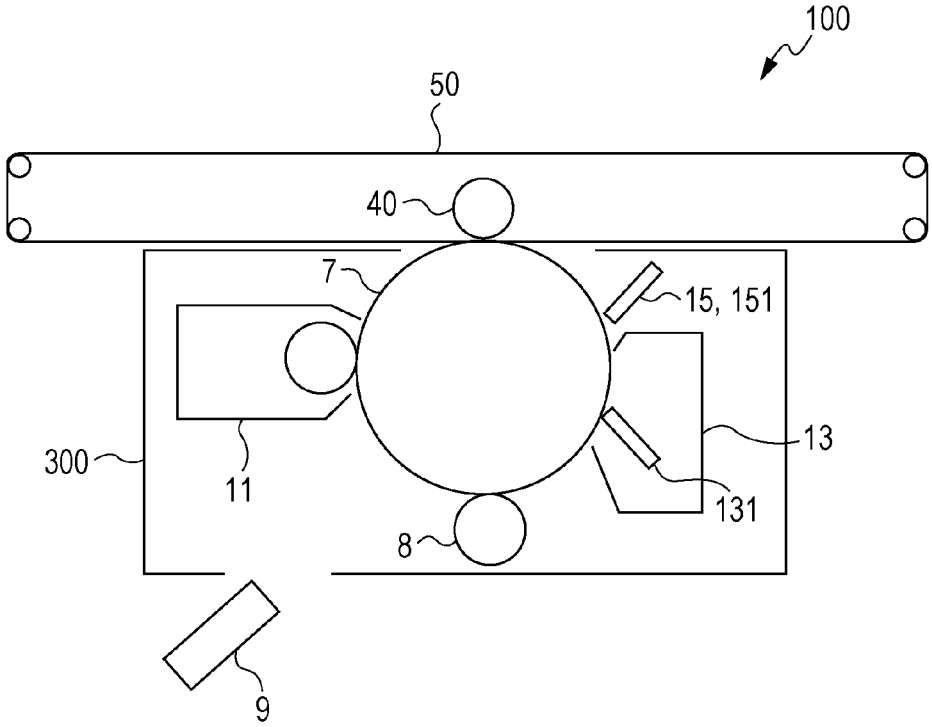
FIG. 1 is a schematic diagram illustrating an example of an image forming apparatus according to an exemplary embodiment.

Exemplary embodiments of the present invention will now be described in detail.

Image Forming Apparatus

An image forming apparatus according to an exemplary embodiment includes an electrophotographic photoreceptor (hereinafter may be simply referred to as a "photoreceptor"), a charging device that charges a surface of the photoreceptor, an electrostatic latent image forming device that forms an electrostatic latent image on the charged surface of the photoreceptor, a developing device that houses a developer containing a toner having toner particles and develops the electrostatic latent image on the surface of the photoreceptor by using the developer to form a toner image, a transfer device that transfers the toner image onto a surface of a recording medium, a cleaning device that removes residual matters on the surface of the photoreceptor by bringing a cleaning blade into contact with the photoreceptor, and an intercepting device that includes an intercepting member that intercepts toner particles remaining on the surface of the photoreceptor.

The photoreceptor includes a conductive substrate, a photosensitive layer on the conductive substrate, and an inorganic protective layer constituting the outermost surface layer and being disposed on the photosensitive layer.

The intercepting device includes an intercepting member separated from the photoreceptor by a gap such that the distance (hereinafter may be referred to as a "gap distance") from the surface of the photoreceptor is 0.3 to 0.9 or about 0.3 to 0.9 (inclusive) times the volume-average particle size of the toner particles. The intercepting device intercepts residual toner particles (toner particles remaining on the surface of the photoreceptor) at a position downstream of the transfer device and upstream of the cleaning device in the photoreceptor rotation direction.

The "gap distance" refers to the shortest distance between the surface of the photoreceptor and the photoreceptor-side tip of the intercepting device.

Since the image forming apparatus according to the exemplary embodiment includes an intercepting device that includes an intercepting member arranged such that the gap distance is 0.3 to 0.9 (inclusive) times the volume-average particle size of the toner particles, occurrence of image deletion at high temperature and high humidity is suppressed. Although the exact reason for this is not yet known, the following assumption is made.

A photoreceptor that includes an inorganic protective layer advantageously has a long service life since the inorganic protective layer is hard.

In an electrophotographic image forming apparatus, corona products sometimes occur due to reaction with oxygen, nitrogen, etc., in the air along with discharging operation of the charging device and the like disposed near the photoreceptor. When these corona products attach to the surface of the photoreceptor, the attached corona products absorb moisture in a high-temperature, high-humidity (for example, 29° C., 80% RH) environment and lower the surface resistance of the photoreceptor. This obstructs retention of the electrostatic latent image on the photoreceptor and image deletion is prone to occur.

If the photoreceptor has an organic layer (for example, an organic photosensitive layer or an organic protective layer) as the outermost surface layer, flexibility inherent to the organic material allows the cleaning blade to scrape off the surface layer of the organic layer constituting the outermost surface layer, thereby removing corona products.

However, when a photoreceptor includes an inorganic protective layer as the outermost surface layer, the inorganic protective layer is hard and it is difficult to remove corona products by scraping off the surface layer of the inorganic protective layer. Thus, when the photoreceptor includes an inorganic protective layer at the outermost surface, the cleaning blade cleaning the surface of the photoreceptor in a contact manner may remove the toner particles and external additive particles but not the corona products. Thus, corona products tend to remain on the surface of the photoreceptor and it is difficult to suppress occurrence of image deletion in a high-temperature, high-humidity environment.

To address this phenomenon, the image forming apparatus according to the exemplary embodiment includes an intercepting device that includes an intercepting member arranged such that the gap distance is 0.3 to 0.9 (inclusive) times the volume-average particle size of the toner particles.

Since the gap distance is within the above-mentioned range, the toner particles left un-transferred by the transfer device and remaining on the photoreceptor surface do not pass through the gap between the intercepting member and the photoreceptor surface, and are intercepted thereat. When the toner particles are intercepted, they accumulate to form a toner reservoir. As the photoreceptor keeps rotating under such conditions, the toner reservoir scrubs the surface of the photoreceptor and presumably removes corona products attached to the surface of the photoreceptor.

As the toner particles accumulate in the toner reservoir and the quantity of the toner reservoir increases, the pressure generated as a result causes some portion of the toner reservoir to pass through the gap between the intercepting member and the photoreceptor surface. As a result, the quantity of the toner reservoir is maintained at an appropriate level without an excessive increase. The portion of the toner reservoir that has passed through the gap between the intercepting member and the photoreceptor surface, small-size external additives, and the like components are intercepted by the cleaning blade of the cleaning device and removed from the surface of the photoreceptor.

As described above, in this exemplary embodiment, prior to cleaning the surface of the photoreceptor by bringing the cleaning blade in contact with the surface, the intercepting member with the gap distance in the above-mentioned range forms a toner reservoir of an appropriate quantity. Thus, even when the outermost surface layer is an inorganic protective layer, corona products attached to the photoreceptor surface are removed by the toner reservoir of an appropriate quantity formed by the intercepting member and occurrence of image deletion in a high-temperature, high-humidity environment is suppressed.

It is presumed that because of this configuration, occurrence of image deletion in a high-temperature, high-humidity environment is suppressed in this exemplary embodiment.

The image forming apparatus according to the exemplary embodiment is applicable to known image forming apparatuses such as an apparatus equipped with a fixing device that fixes a toner image transferred onto a surface of a recording medium, a direct-transfer-type apparatus configured to directly transfer a toner image formed on a surface of an electrophotographic photoreceptor onto a recording medium, an intermediate-transfer-type apparatus configured to transfer a toner image formed on a surface of an electrophotographic photoreceptor onto a surface of an intermediate transfer body (first transfer) and then transfer the toner image on the surface of the intermediate transfer body onto a surface of a recording medium (second transfer), an apparatus equipped with a charge erasing device that irradiates a surface of an electrophotographic photoreceptor with a charge erasing beam after transfer of a toner image and before charging so as to erase charges, and an apparatus equipped with an electrophotographic photoreceptor-heating member configured to increase the temperature of an electrophotographic photoreceptor and decrease the relative temperature.

For an intermediate-transfer-type apparatus, the transfer device includes, for example, an intermediate transfer body having a surface onto which a toner image is transferred, a first transfer device configured to transfer a toner image on a surface of the electrophotographic photoreceptor onto a surface of the intermediate transfer body, and a second transfer device configured to transfer the toner image on the surface of the intermediate transfer body onto a surface of a recording medium.

The image forming apparatus according to the exemplary embodiment may be of a dry development type or a wet development type (development type that uses a liquid developer).

In the image forming apparatus of the exemplary embodiment, for example, the section equipped with an electrophotographic photoreceptor, a developing device, a cleaning device, and an intercepting device may have a cartridge configuration (process cartridge) attachable to and detachable from the image forming apparatus. The process cartridge may be one equipped with the electrophotographic photoreceptor according to the exemplary embodiment. The process cartridge may include, in addition to the electrophotographic photoreceptor, the developing device, the cleaning device, and the intercepting device, at least one selected from a charging device, an electrostatic latent image forming device, and a transfer device.

The image forming apparatus of the exemplary embodiment may be implemented in an image forming method that includes a charging step of charging a surface of an electrophotographic photoreceptor, an electrostatic latent image forming step of forming an electrostatic latent image on the charged surface of the electrophotographic photoreceptor, a developing step of developing the electrostatic latent image on the surface of the electrophotographic photoreceptor by using a developer containing a toner having toner particles so as to form a toner image, a transfer step of transferring the toner image onto a surface of a recording medium, an intercepting step of using an intercepting member to intercept toner particles remaining on the surface of the photoreceptor, and a cleaning step of bringing a cleaning blade into contact with the surface of the photoreceptor to remove residual matters on the surface of the photoreceptor.

One non-limiting example of an image forming apparatus according to the exemplary embodiment will now be described. Only the relevant components illustrated in the drawings are described and descriptions of other components are omitted.

FIG. 1 is a schematic diagram illustrating an example of an image forming apparatus according to the exemplary embodiment.

An image forming apparatus 100 according to the exemplary embodiment includes, as shown in FIG. 1, a process cartridge 300 that includes an electrophotographic photoreceptor 7, a developing device 11, a cleaning device 13, and an intercepting device 15; a developing device 9 (one example of the electrostatic latent image forming device); a transfer device 40 (first transfer device); and an intermediate transfer body 50. In the image forming apparatus 100, an exposing device 9 is positioned so that the electrophotographic photoreceptor 7 can be exposed through an opening of the process cartridge 300. The transfer device 40 is positioned to oppose the electrophotographic photoreceptor 7 with the intermediate transfer body 50 therebetween. The intermediate transfer body 50 is positioned so that a portion thereof is in contact with the electrophotographic photoreceptor 7. Although not shown in the drawing, a second transfer device that transfers the toner image on the intermediate transfer body 50 onto a recording medium (for example, paper sheet) is also included in the apparatus. The intermediate transfer body 50, the transfer device 40 (first transfer device), and the second transfer device (not illustrated) is an example of the transfer device.

The process cartridge 300 illustrated in FIG. 1 includes a housing that integrally supports the electrophotographic photoreceptor 7, a charging device 8 (one example of the charging device), the developing device 11 (one example of the developing device), the cleaning device 13 (one example of the cleaning device), and the intercepting device 15 (one example of the intercepting device). The cleaning device 13 includes a cleaning blade (one example of a cleaning member) 131. The cleaning blade 131 is arranged to come into contact with a surface of the electrophotographic photoreceptor 7. The cleaning member may be a conductive or insulating fibrous member instead of or used in combination with the cleaning blade 131.

Figure 2:
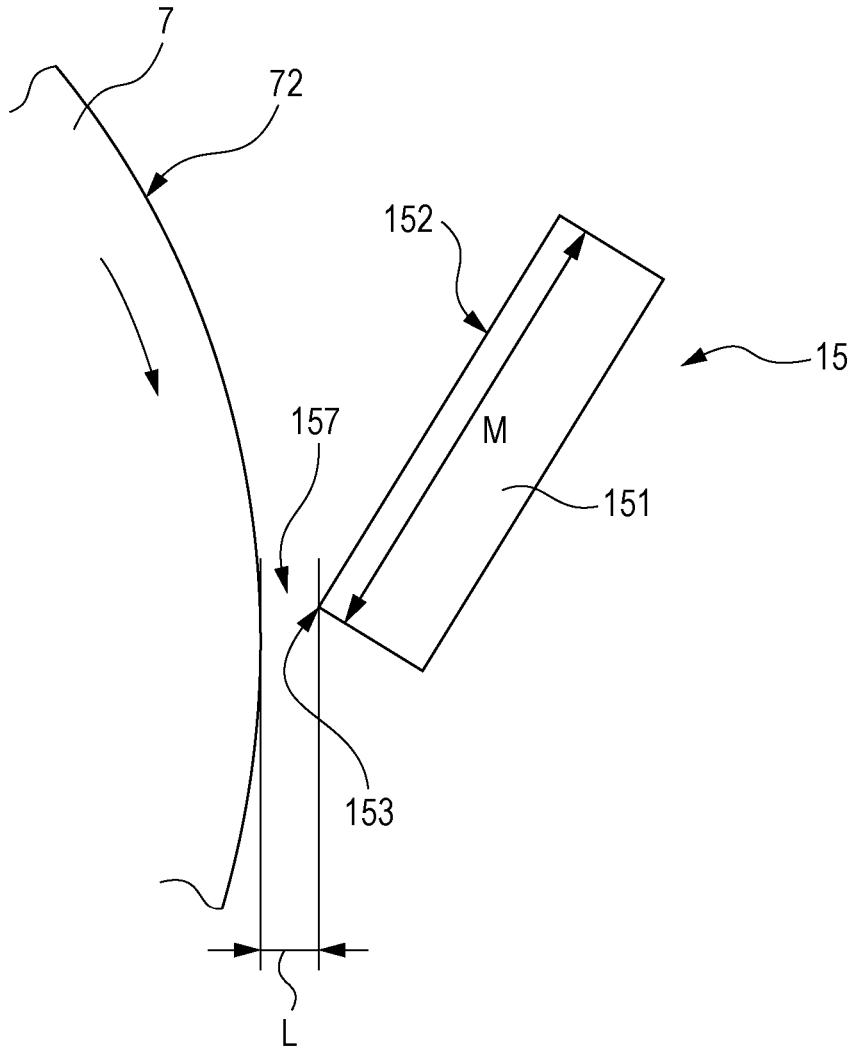
FIG. 2 is a schematic diagram illustrating an example of an intercepting device according to the exemplary embodiment.

The intercepting device 15 includes, as shown in FIG. 2, an intercepting member 151 separated from a surface 72 of the electrophotographic photoreceptor 7 by a gap. The shortest distance L (gap distance L) between the surface 72 of the electrophotographic photoreceptor 7 and a portion 153 of the intercepting member 151 that opposes the electrophotographic photoreceptor 7 is 0.3 to 0.9 (inclusive) times the volume-average particle size of toner particles of the toner contained in the developing device 11.

Although the intercepting member 151 illustrated in FIG. 2 is a plate-shaped member, the shape is not limited to this as long as the member has a surface that intercepts the toner particles and extends from one end to the other end in an axis direction of the electrophotographic photoreceptor 7. For example, the intercepting member 151 may have a triangular prism shape, a columnar shape, a crescent shape, or a warping plate shape.

The respective components of the image forming apparatus according to the exemplary embodiment will now be described.

Electrophotographic Photoreceptor

The electrophotographic photoreceptor 7 is a photoreceptor that includes a conductive substrate, a photosensitive layer on the conductive substrate, and an inorganic protective layer on the photosensitive layer.

The photosensitive layer may be an organic photosensitive layer or an inorganic photosensitive layer.

The organic photosensitive layer refers to a layer that contains a binder resin, which is an organic material, in addition to a charge generating material and a charge transporting material that enable the layer to function as the photosensitive layer. The organic photosensitive layer may be a single-layer-type organic photosensitive layer that has a charge generating capacity and a charge transporting capacity or may be a separated-function-type (multilayer) organic photosensitive layer that includes a charge generating layer and a charge transporting layer.

The inorganic photosensitive layer refers to a layer that contains an inorganic material as a component that accounts for 80% by weight or more of the layer. An example thereof is an amorphous silicon photosensitive layer.

The inorganic protective layer refers to a layer that contains an inorganic material as a component that accounts for 80% by weight or more of the layer and constitutes a surface of the photoreceptor. From the viewpoint of long service life of the photoreceptor, the inorganic protective layer may be layer that contains 90% by weight or more of the inorganic material.

In this exemplary embodiment, when the photosensitive layer is an organic photosensitive layer, the layer constituting the surface of the organic photosensitive layer (the surface on the inorganic protective layer side) may contain inorganic particles in order to suppress cracking of the inorganic protective layer and suppress generation of residual potential.

In other words, when the organic photosensitive layer is a single-layer-type organic photosensitive layer, the single-layer-type organic photosensitive layer may contain inorganic particles.

When the organic photosensitive layer is a separated-function-type organic photosensitive layer that includes a charge generating layer and a charge transporting layer, the charge transporting layer, which constitutes the surface, may contain inorganic particles. However, when the charge transporting layer includes two or more layers, the charge transporting layer which is a layer that constitutes the surface (the charge transporting layer on the inorganic protective layer side) may contain inorganic particles.

In the description below, an electrophotographic photoreceptor in which the photosensitive layer is an organic photosensitive layer is described in detail as one example of the electrophotographic photoreceptor according to the exemplary embodiment with reference to the drawings. The same or corresponding components in the drawings are represented by the same reference signs and description therefor are omitted to avoid redundancy.

Figure 3:
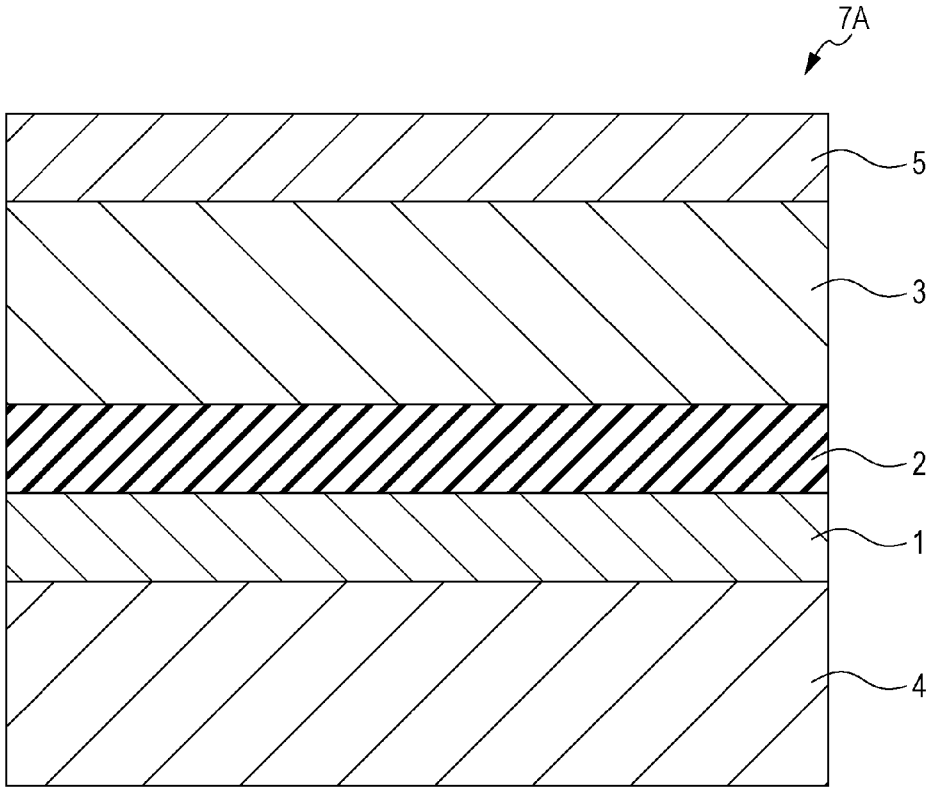
FIG. 3 is a schematic cross-sectional view of an example of a layer configuration of an electrophotographic photoreceptor according to the exemplary embodiment.
Figure 4:
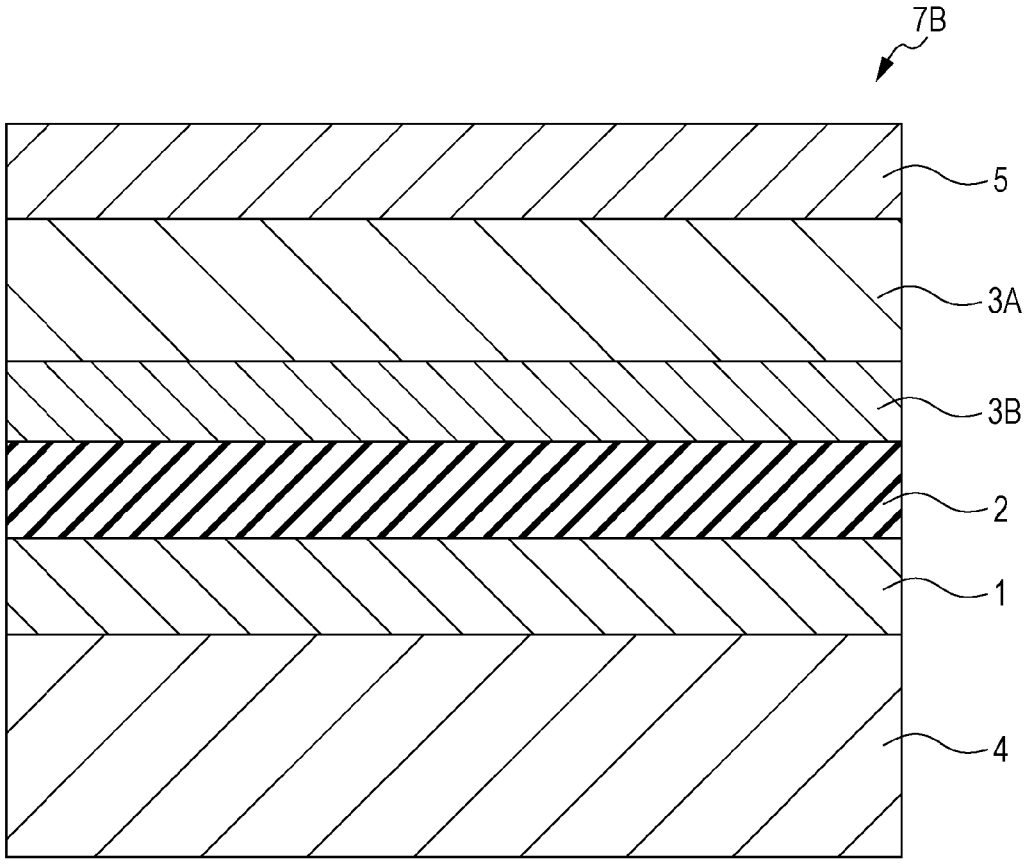
FIG. 4 is a schematic cross-sectional view of another example of the layer configuration of the electrophotographic photoreceptor according to the exemplary embodiment.
Figure 5:
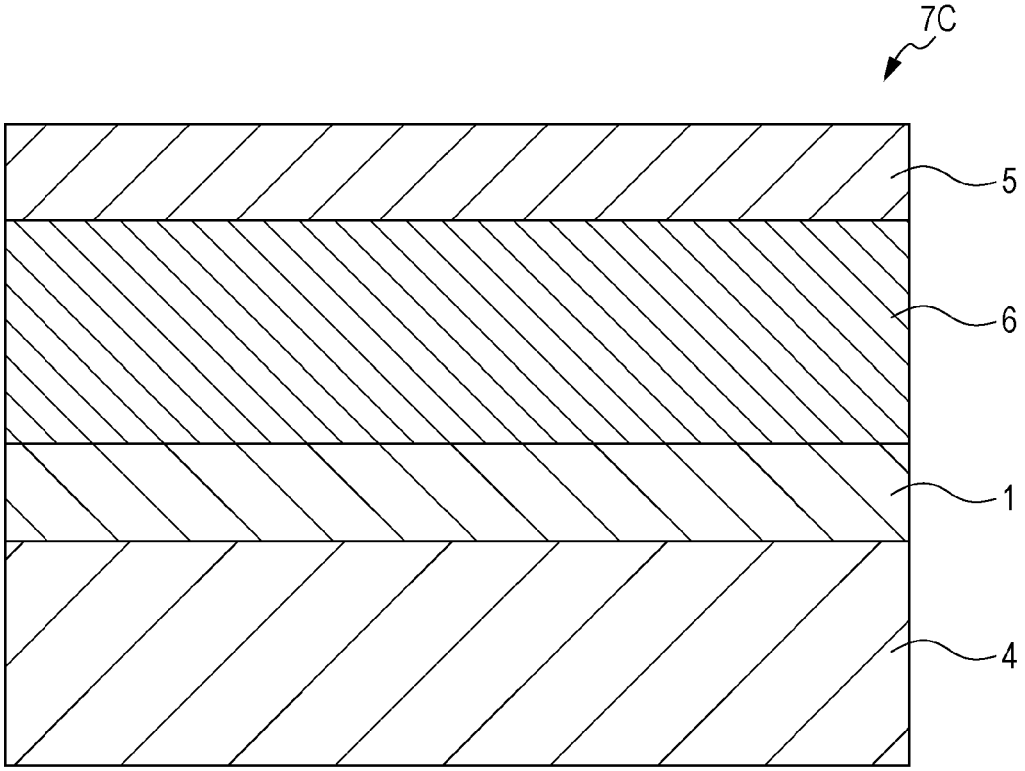
FIG. 5 is a schematic cross-sectional view of yet another example of the layer configuration of the electrophotographic photoreceptor according to the exemplary embodiment.

FIG. 3 is a schematic cross-sectional view of an example of an electrophotographic photoreceptor according to the exemplary embodiment. FIGS. 4 and 5 are schematic cross-sectional views of other examples of the electrophotographic photoreceptor according to the exemplary embodiment.

An electrophotographic photoreceptor 7A illustrated in FIG. 3 is a separated-function-type photoreceptor (or multilayer photoreceptor). An undercoat layer 1 is disposed on a conductive substrate 4, and a charge generating layer 2, a charge transporting layer 3, and an inorganic protective layer 5 are stacked in this order on the undercoat layer 1. In the electrophotographic photoreceptor 7A, the charge generating layer 2 and the charge transporting layer 3 constitute an organic photosensitive layer.

From the viewpoints of suppressing cracking of the inorganic protective layer and generation of residual potential, the charge transporting layer 3 may contain inorganic particles together with a charge transporting material.

An electrophotographic photoreceptor 7B illustrated in FIG. 4 is of a separated function type that includes a charge generating layer 2 and a charge transporting layer 3, as with the electrophotographic photoreceptor 7A illustrated in FIG. 3, but the charge transporting layer 3 is further function-separated.

An electrophotographic photoreceptor 7C illustrated in FIG. 5 includes a layer that contains both a charge generating material and a charge transporting material (single-layer-type organic photosensitive layer 6 (charge generating/transporting layer)).

In the electrophotographic photoreceptor 7B illustrated in FIG. 4, the undercoat layer 1 is disposed on the conductive substrate 4. A charge generating layer 2, a charge transporting layer 3B, a charge transporting layer 3A, and an inorganic protective layer 5 are stacked on the undercoat layer 1 in that order. In the electrophotographic photoreceptor 7B, the charge transporting layer 3A, the charge transporting layer 3B, and the charge generating layer 2 constitute an organic photosensitive layer.

From the viewpoint of suppressing cracking of the inorganic protective layer and generation of residual potential, the charge transporting layer 3A may contain inorganic particles in addition to a charge transporting material. The charge transporting layer 3B contains at least a charge transporting material and may contain inorganic particles.

In the electrophotographic photoreceptor 7C illustrated in FIG. 5, an undercoat layer 1 is disposed on a conductive substrate 4, and a single-layer-type organic photosensitive layer 6 and an inorganic protective layer 5 are stacked on the undercoat layer 1 in that order.

From the viewpoints of suppressing cracking of the inorganic protective layer and generation of residual potential, the single-layer-type organic photosensitive layer 6 may contain inorganic particles in addition to a charge generating material and a charge transporting material.

The undercoat layers 1 of the electrophotographic photoreceptors illustrated in FIGS. 3 to 5 are optional.

In the description below, individual components of the electrophotographic photoreceptor 7A illustrated in FIG. 3 are described as representative examples. In the description, reference signs may be omitted.

Conductive Substrate

Examples of the conductive substrate include metal plates, metal drums, and metal belts that contain metals (aluminum, copper, zinc, chromium, nickel, molybdenum, vanadium, indium, gold, platinum, etc.) or alloys (stainless steels etc.), and paper sheets, resin films, and belts having coatings formed by application, vapor deposition, or laminating using conductive compounds (for example, conductive polymers and indium oxide), metals (for example, aluminum, palladium, and gold), or alloys. The term "conductive" means that the volume resistivity is less than $10^{13}$ Ωcm.

When the electrophotographic photoreceptor is to be used in a laser printer, the surface of the conductive substrate may be roughened to a center-line-average roughness Ra of 0.04 μm or more and 0.5 μm or less in order to suppress interference fringes during laser beam irradiation. When an incoherent light is used as a light source, roughening is not particularly needed for the purpose of preventing interference fringes but may be performed to obtain a longer service life since defects caused by irregularities on the surface of the conductive substrate are reduced.

Examples of the roughening method include wet honing that involves spraying a suspension of an abrasive in water onto a supporting body, centerless grinding that involves continuously grinding the conductive substrate by pressing the conductive substrate against a rotating grinding stone, and anodization.

Another example of a method for obtaining a rough surface involves forming a layer containing a resin and dispersed conductive or semi-conductive particles on a surface of the conductive substrate so that the particles dispersed in the layer create roughness. According to this method, the surface of the conductive substrate is not directly roughened.

Roughening by anodization involves conducting anodization by using a metal (e.g., aluminum) conductive substrate as the anode in an electrolytic solution so as to form an oxide film on the surface of the conductive substrate. Examples of the electrolytic solution include a sulfuric acid solution and an oxalic acid solution. However, the anodized film formed by anodization is porous, and is thus chemically active and susceptible to contamination as is. Moreover, the resistance thereof fluctuates depending on the environment. Thus the porous anodized film may be subjected to a pore stopping treatment with which the fine pores of the oxide film are stopped by volume expansion caused by hydration reaction in compressed steam or boiling water (a metal salt such as a nickel salt may be added) so as to convert the oxide into a more stable hydrous oxide.

The thickness of the anodized film may be, for example, 0.3 μm or more and 15 μm or less. When the thickness is in this range, the anodized film has a tendency of exhibiting a barrier property against injection. Moreover, the increase in residual potential due to repeated use tends to be suppressed.

The conductive substrate may be treated with an acidic treatment solution or subjected to a Boehmite treatment.

The treatment with an acidic treatment solution is, for example, carried out as follows. First, an acidic treatment solution containing phosphoric acid, chromic acid, and hydrofluoric acid is prepared. The blend ratios of phosphoric acid, chromic acid, and hydrofluoric acid in the acidic treatment solution are, for example, phosphoric acid: 10% by weight or more and 11% by weight or less, chromic acid: 3% by weight or more and 5% by weight or less, and hydrofluoric acid: 0.5% by weight or more and 2% by weight or less. The total acid concentration may be 13.5% by weight or more and 18% by weight or less. The treatment temperature may be, for example, 42° C. or higher and 48° C. or lower. The thickness of the coating film may be 0.3 μm or more and 15 μm or less.

The Boehmite treatment is conducted, for example, by immersing the conductive substrate in pure water at 90° C. or higher and 100° C. or lower for 5 minutes to 60 minutes or bringing the conductive substrate into contact with hot compressed steam at 90° C. or higher and 120° C. or lower for 5 minutes to 60 minutes. The thickness of the film may be 0.1 μm or more and 5 μm or less. The resulting conductive substrate may be further subjected to an anodization treatment by using an electrolytic solution that has a low film dissolving power, such as adipic acid, boric acid, borate, phosphate, phthalate, maleate, benzoate, tartrate, or citrate.

Undercoat Layer

The undercoat layer is, for example, a layer that contains inorganic particles and a binder resin.

Examples of the inorganic particles are those having a powder resistance (volume resistivity) of $10^2$ Ωcm or more and $10^{11}$ Ωcm or less.

Examples of the inorganic particles having such a resistance value include metal oxide particles such as tin oxide particles, titanium oxide particles, zinc oxide particles, and zirconium oxide particles. Zinc oxide particles may be used as the inorganic particles.

The Brunauer-Emmett-Teller (BET) specific surface area of the inorganic particles may be, for example, 10 $m^2/g$ or more.

The volume-average particle size of the inorganic particles may be, for example, 50 nm or more and 2000 nm or less or 60 nm or more and 1000 nm or less.

The inorganic particle content relative to, for example, the binder resin may be 10% by weight or more and 80% by weight or less or may be 40% by weight or more and 80% by weight or less.

The inorganic particles may have treated surfaces. A mixture of two or more types of inorganic particles subjected different surface treatments or having different particle sizes may be used.

Examples of the surface treatment agent include a silane coupling agent, a titanate coupling agent, an aluminum coupling agent, and a surfactant. In particular, a silane coupling agent or, to be more specific, an amino-containing silane coupling agent may be used.

Examples of the amino-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in combination. For example, a combination of an amino-containing silane coupling agent and another silane coupling agent may be used. Examples of this another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method using the surface treatment agent may be any known method and may be a wet method or a dry method.

The amount of the surface treatment agent used may be 0.5% by weight or more and 10% by weight or less relative to the inorganic particles, for example.

The undercoat layer may contain an electron accepting compound (acceptor compound) as well as inorganic particles. This is because long-term stability of electric properties and the carrier blocking property are enhanced.

Examples of the electron accepting compounds include electron transporting substances such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

A compound having an anthraquinone structure may be used as the electron-accepting compound. Examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron accepting compound may be co-dispersed with the inorganic particles in the undercoat layer. Alternatively, the electron accepting compound may be attached to the surfaces of the inorganic particles and contained in the undercoat layer.

A method for causing the electron accepting compound to attach to the surfaces of the inorganic particles may be a dry method or a wet method.

According to a dry method, for example, while inorganic particles are stirred with a mixer or the like having a large shear force, an electron accepting compound as is or dissolved in an organic solvent is dropped or sprayed along with dry air or nitrogen gas so as to cause the electron accepting compound to attach to the surfaces of the inorganic particles. When the electron accepting compound is dropped or sprayed, the temperature may be not higher than the boiling point of the solvent. After the electron accepting compound is dropped or sprayed, baking may be further conducted at 100° C. or higher. Baking may be conducted at any temperature for any amount of time as long as electrophotographic properties are obtained.

According to a wet method, while inorganic particles are dispersed in a solvent through stirring or by using ultrasonic waves, a sand mill, an attritor, a ball mill, or the like, an electron accepting compound is added thereto and the resulting mixture is stirred or dispersed, followed by removal of the solvent to cause the electron accepting compound to attach to the surfaces of the inorganic particles. The solvent is removed by, for example, filtration or distillation. After removal of the solvent, baking may be conducted at 100° C. or higher. Baking may be conducted at any temperature for any amount of time as long as electrophotographic properties are obtained. In the wet method, the water contained in the inorganic particles may be removed prior to adding the electron accepting compound. For example, water may be removed by stirring the inorganic particles in a solvent under heating or azeotropically with the solvent.

The electron accepting compound may be attached to the inorganic particles before, after, or at the same time as treating the surface with a surface treatment agent.

The electron accepting compound content relative to, for example, the inorganic particles may be 0.01% by weight or more and 20% by weight or less or 0.01% by weight or more and 10% by weight or less.

Examples of the binder resin used in the undercoat layer include known polymer materials such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; and other known materials such as zirconium chelate compounds, titanium chelate compounds, aluminum chelate compounds, titanium alkoxide compounds, organic titanium compounds, and silane coupling agents.

Other examples of the binder resin used in the undercoat layer include a charge transporting resin having a charge transporting group and a conductive resin (e.g., polyaniline).

Among these, a resin insoluble in the coating solvent contained in the overlying layer may be used as the binder resin contained in the undercoat layer. Examples thereof include thermosetting resins such as urea resins, phenolic resins, phenol-formaldehyde resins, melamine resins, urethane resins, unsaturated polyester resins, alkyd resins, and epoxy resins; and resins obtained by reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin.

When two or more of these binder resins are used in combination, the mixing ratio is set as desired.

The undercoat layer may contain various additives that improve electrical properties, environmental stability, and image quality.

Examples of the additives include known materials such as electron transporting pigments based on fused polycyclic and azo materials, zirconium chelate compounds, titanium chelate compounds, aluminum chelate compounds, titanium alkoxide compounds, organic titanium compounds, and silane coupling agents. Although a silane coupling agent is used in a surface treatment of inorganic particles as discussed above, it may also be added to the undercoat layer as an additive.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compound include zirconium butoxide, zirconium ethyl acetoacetate, zirconium triethanolamine, zirconium acetylacetonate butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butylate, diethylacetoacetate aluminum diisopropylate, and aluminum tris(ethyl acetoacetate).

These additives may be used alone or as a mixture or a polycondensation product of two or more compounds.

The undercoat layer may have a Vickers hardness of 35 or more.

The surface roughness (ten-point average roughness) of the undercoat layer may be adjusted to 1/(4n) (n: refractive index of overlying layer) to ½ of the exposure laser wavelength λ in order to suppress moire images.

Resin particles and the like may be added to the undercoat layer to adjust the surface roughness. Examples of the resin particles include silicone resin particles and crosslinked polymethyl methacrylate resin particles. The surface of the undercoat layer may be polished to adjust the surface roughness. Examples of the polishing method include buff polishing, sand blasting, wet honing, and grinding.

The undercoat layer may be formed by any known method. For example, a coating solution for forming an undercoat layer may be prepared by adding the above-described components to a solvent, forming a coating film by using this coating solution, drying the coating film, and, if needed, heating the coating film.

Examples of the solvent used to prepare the coating solution for forming an undercoat layer include known organic solvents such as alcohol solvents, aromatic hydrocarbon solvents, halogenated hydrocarbon solvents, ketone solvents, ketone alcohol solvents, ether solvents, and ester solvents.

Specific examples of these solvents include ordinary organic solvents such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the coating solution for forming an undercoat layer include known methods that use a roll mill, a ball mill, a vibrating ball mill, an attritor, a sand mill, a colloid mill, and a paint shaker.

Examples of the method for applying the coating solution for forming an undercoat layer onto the conductive substrate include known methods such as a blade coating method, a wire bar coating method, a spray coating method, a dip coating method, a bead coating method, an air knife coating method, and a curtain coating method.

The thickness of the undercoat layer may be set to 15 μm or more, or may be set to 20 μm or more and 50 μm or less.

Intermediate Layer

An intermediate layer may be formed between the undercoat layer and the photosensitive layer although this is not illustrated in the drawings.

The intermediate layer is, for example, a layer that contains a resin. Examples of the resin contained in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organic metal compound. Examples of the organic metal compound contained in the intermediate layer include organic metal compounds containing metal atoms such as zirconium, titanium, aluminum, manganese, and silicon atoms.

These compounds to be contained in the intermediate layer may be used alone or as a mixture or a polycondensation product of two or more compounds.

The intermediate layer may be a layer that contains an organic compound that contains a zirconium atom or a silicon atom, in particular.

The intermediate layer may be formed by any known method. For example, a coating solution for forming the intermediate layer may be prepared by adding the above-described components to a solvent and applied to form a coating film, and the coating film may be dried and, if desired, heated.

Examples of the method for applying the solution for forming the intermediate layer include known methods such as a dip coating method, a lift coating method, a wire bar coating method, a spray coating method, a blade coating method, a knife coating method, and a curtain coating method.

The thickness of the intermediate layer is, for example, set within the range of 0.1 μm or more and 3 μm or less. The intermediate layer may be used as an undercoat layer.

Charge Generating Layer

The charge generating layer is a layer that contains a charge generating material and a binder resin, for example. The charge generating layer may be a layer formed by vapor deposition of a charge generating material. The vapor deposited layer of the charge generating material is suitable when an incoherent light source such as a light-emitting diode (LED) or an organic electro-luminescence (EL) image array is used as the light source.

Examples of the charge generating material include azo pigments such as bisazo and trisazo pigments; fused aromatic pigments such as dibromoanthanthrone; perylene pigments; pyrrolopyrrole pigments; phthalocyanine pigments; zinc oxide; and trigonal selenium.

Among these, a metal phthalocyanine pigment or a metal-free phthalocyanine pigment may be used as the charge generating material in order to allow use of near infrared laser exposure. Specific examples thereof include hydroxygallium phthalocyanine, chlorogallium phthalocyanine, dichlorotin phthalocyanine, and titanyl phthalocyanine.

In order to allow use of near-ultraviolet laser exposure, the charge generating material may be a fused aromatic pigment such as dibromoanthanthrone, a thioindigo pigment, a porphyrazine compound, zinc oxide, trigonal selenium, or a bisazo pigment, for example.

The above-described charge generating material may be used in the case where an incoherent light source, such as an LED or organic EL image array, having an emission center wavelength in the range of 450 nm or more and 780 nm or less is used. However, when the photosensitive layer is as thin as 20 μm or less to improve resolution, the field strength in the photosensitive layer increases and electrification resulting from charge injection from the substrate decreases, thereby readily generating image defects known as black spots. This phenomenon is notable when a charge generating material, such as trigonal selenium or a phthalocyanine pigment, that is a p-type semiconductor and readily generates dark current is used.

In contrast, when an n-type semiconductor such as a fused aromatic pigment, a perylene pigment, or an azo pigment is used as the charge generating material, dark current rarely occurs and fewer image defects called black spots occur despite a small thickness.

Whether the semiconductor is n-type or not is determined by a typical time-of-flight technique and by the polarity of photoelectric current flowing therein. A semiconductor that allows electrons rather than holes to flow as a carrier is assumed to be the n-type.

The binder resin used in the charge generating layer is selected from a wide variety of insulating resins. The binder resin may be selected from organic photoconductive polymers such as poly-N-vinylcarbazole, polyvinyl anthracene, polyvinyl pyrene, and polysilane.

Examples of the binder resin include polyvinyl butyral resins, polyarylate resins (polycondensation products of bisphenols and aromatic divalent carboxylic acids, etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" means that the volume resistivity is $10^{13}$ Ωcm or more.

These binder resins may be used alone or as a mixture or two or more.

The blend ratio of the charge generating material to the binder resin may be within the range of 10:1 to 1:10 on a weight basis.

The charge generating layer may contain other known additives.

The charge generating layer may be formed by any known method. For example, a charge generating layer-forming coating solution may be prepared by adding the above-described components to a solvent and applied to form a coating film, and the coating film may be dried and, if desired, heated. The charge generating layer may also be formed by vapor deposition of a charge generating material. Formation of the charge generating layer by vapor deposition may be employed when a fused aromatic pigment or a perylene pigment is used as the charge generating material.

Examples of the solvent for preparing the charge generating layer-forming coating solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or as a mixture of two or more.

The technique for dispersing particles (for example, a charge generating material) in the charge generating layer-forming coating solution includes those which use a medium disperser such as a ball mill, a vibrating ball mill, an attritor, a sand mill, or a horizontal sand mill, and a medium-less disperser such as an agitator, an ultrasonic disperser, a roll mill, and a high-pressure homogenizer. Examples of the high-pressure homogenizers include collision-type homogenizers with which a dispersion is dispersed under a high pressure through liquid-liquid collision or liquid-wall collision, or a penetration-type homogenizer with which a material is caused to penetrate through narrow channels under a high pressure.

In conducting dispersion, it is effective to control the average particle size of the charge generating material in the charge generating layer-forming coating solution to 0.5 μm or less, 0.3 μm or less in some cases, or 0.15 μm or less in some cases.

Examples of the technique of applying the charge generating layer-forming coating solution onto the undercoat layer (or intermediate layer) include typical techniques such as a blade coating technique, a wire bar coating technique, a spray coating technique, a dip coating technique, a bead coating technique, an air knife coating technique, and a curtain coating technique.

The thickness of the charge generating layer may be, for example, 0.1 μm or more and 5.0 μm or less in some cases and may be 0.2 μm or more and 2.0 μm or less in some cases.

Charge Transporting Layer

A charge transporting layer is a layer that contains, for example, a charge transporting material and a binder resin. The charge transporting layer may be a layer that contains a polymer charge transporting material.

Examples of the charge transporting material include quinone-based compounds such as p-benzoquinone, chloranil, bromanil, and anthraquinone; tetracyanoquinodimethane-based compounds; fluorenone compounds such as 2,4,7-trinitrofluorenone; xanthone-based compounds; benzophenone-based compounds; cyanovinyl-based compounds; and ethylene-based compounds. Examples of hole transporting compounds that may be used as the charge transporting material include triarylamine-based compounds, benzidine-based compounds, aryl alkane-based compounds, aryl-substituted ethylene-based compounds, stilbene-based compounds, anthracene-based compounds, and hydrazone-based compounds. These charge transporting materials are non-limiting examples and may be used alone or in combination.

From the viewpoint of charge mobility, the charge transporting material may be a triarylamine derivative represented by structural formula (a-1) below or a benzidine derivative represented by structural formula (a-2) below.

(a-1)

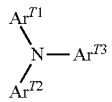

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituents of the groups described above include a halogen atom, an alkyl group having 1 to 5 carbon atoms, and an alkoxy group having 1 to 5 carbon atoms. A substituted amino group substituted with an alkyl group having 1 to 3 carbon atoms may also be used as the substituent for the groups described above.

(a-2)

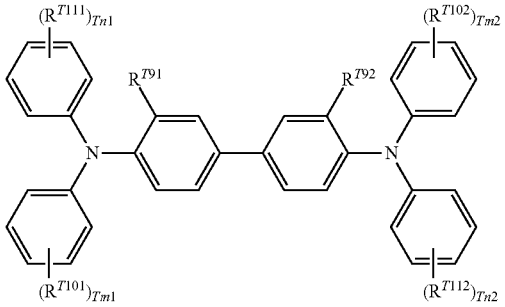

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$. $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituents of the groups described above include a halogen atom, an alkyl group having 1 to 5 carbon atoms, and an alkoxy group having 1 to 5 carbon atoms. A substituted amino group substituted with an alkyl group having 1 to 3 carbon atoms may also be used as the substituent of the group.

Among the triarylamine derivatives represented by structural formula (a-1) and benzidine derivatives represented by structural formula (a-2), triarylamine derivatives having "$—C_6H_4—CH=CH—CH=C(R^{T7})(R^{T8})$" and benzidine derivatives having "$—CH=CH—CH=C(R^{T15})(R^{T16})$" may be used from the viewpoint of charge mobility.

Charge transporting materials that are commonly available such as poly-N-vinyl carbazole and polysilane are used as the polymer charge transporting material. Specifically, polyester-based polymer charge transporting materials may be used. The polymer charge transporting material may be used alone or in combination with a binder resin.

Examples of the binder resin used in the charge transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, polycarbonate resins and polyarylate resins are particularly suitable as the binder resins. These binder resins are used alone or in combination.

The charge transporting material-binder resin blend ratio may be 10:1 to 1:5 in terms of weight.

Among these binder resins described above, from the viewpoint of easily decreasing the surface roughness of the charge transporting layer and further suppressing occurrence of image deletion, polycarbonate resins (homopolymer types such as bisphenol A, bisphenol Z, bisphenol C, and bisphenol TP and copolymer types thereof) may be used. The polycarbonate resins may be used alone or in combination. From the same viewpoint, a homopolymer-type polycarbonate resin of bisphenol Z is particularly suitable among the polycarbonate resins.

The charge transporting layer may contain a charge transporting material and a binder resin, and if needed, inorganic particles.

When the charge transporting layer (in other words, the outermost layer of the organic photosensitive layer) contains inorganic particles, cracking of the inorganic protective layer is suppressed. Specifically, whereas an organic photosensitive layer tends to have flexibility and a tendency to deform, an inorganic protective layer is hard and has a tendency to have poor toughness. Thus, for example, when mechanical load is applied by a member (for example, an intermediate transfer body) in contact with an outer peripheral surface of a photoreceptor and the organic photosensitive layer serving as an undercoat layer of the inorganic protective layer undergoes deformation, the inorganic protective layer may crack. By adding inorganic particles to the layer that constitutes the surface of the organic photosensitive layer, the inorganic particles function as a reinforcer for the organic photosensitive layer. As a result, deformation of the organic photosensitive layer may be avoided and cracking of the inorganic protective layer may be suppressed.

Examples of the inorganic particles used in the charge transporting layer include silica particles, alumina particles, titanium oxide particles, potassium titanate particles, tin oxide particles, zinc oxide particles, zirconium oxide particles, barium sulfate particles, calcium oxide particles, calcium carbonate particles, and magnesium oxide particles.

One type of inorganic particles may be used or two or more types of inorganic particles may be used in combination.

Among these, silica particles may be used since they have a high dielectric loss ratio and rarely degrade electrical properties of the photoreceptor, and suppress occurrence of cracking of the inorganic protective layer.

Silica particles that may be used in the charge transporting layer will now be described in detail.

Examples of the silica particles include dry process silica particles and wet process silica particles.

Examples of the dry process silica particles include pyrogenic silica (fumed silica) obtained by burning silane compounds and deflagration silica obtained by deflagrating metal silicon powder.

Examples of the wet process silica particles include wet silica particles obtained by neutralization reaction between sodium silicate and mineral acid (precipitated silica synthesized and aggregated under alkaline conditions and gel silica particles synthesized and aggregated under acidic conditions), colloidal silica particles obtained by alkalinizing and polymerizing acidic silicates (silica sol particles), and sol-gel silica particles obtained by hydrolysis of organic silane compounds (for example, alkoxy silane).

Among these, pyrogenic silica particles having fewer silanol groups at the surface and a low-porosity structure may be used from the viewpoint of suppressing image defects (suppressing degradation of thin line reproducibility) caused by generation of residual potential and other degradation of electrical properties.

The silica particles may be surface-treated with a hydrophobing agent. The surface treatment decreases the number of silanol groups on the surfaces of the silica particles and tends to suppress generation of residual potential.

Examples of the hydrophobing agent include common silane compounds such as chlorosilane, alkoxysilane, and silazane.

Among these, a silane compound having a trimethylsilyl group, a decylsilyl group, or a phenylsilyl group may be used from the viewpoint of ease of suppressing generation of residual potential. In other words, the surfaces of the silica particles may have trimethylsilyl groups, decylsilyl groups, or phenylsilyl groups.

Examples of the silane compound having a trimethylsilyl group include trimethylchlorosilane, trimethylmethoxysilane, and 1,1,1,3,3,3-hexamethyldisilazane.

Examples of the silane compound having a decylsilyl group include decyltrichlorosilane, decyldimethylchlorosilane, and decyltrimethoxysilane.

Examples of the silane compound having a phenylsilyl group include triphenylmethoxysilane and triphenylchlorosilane.

The condensation ratio of the hydrophobized silica particles (the ratio of Si—O—Si in $SiO_4$— bonds in the silica particles, hereinafter, this ratio is also referred to as a "hydrophobing agent condensation ratio") is, for example, 90% or more, may be 91% or more, or may be 95% or more relative to the silanol groups on the surfaces of the silica particles.

When the hydrophobing agent condensation ratio is within the above-described range, the number of silanol groups on the silica particles is further decreased and generation of residual potential is more easily suppressed.

The hydrophobing agent condensation ratio indicates the ratio of condensed silicon atoms to all sites capable of bonding to silicon atoms in the condensed portions detected by nuclear magnetic resonance (NMR) and is measured as follows.

First, silica particles are separated from the layer. The separated silica particles are subjected to Si CP/MAS NMR analysis with AVANCE III 400 produced by Bruker to determine the peak areas according to the number of substituted SiO. The values for disubstituted ($Si(OH)_2(O—Si)_2$—), trisubstituted ($Si(OH)(O—Si)_3$—), and tetrasubstituted ($Si(O—Si)_4$—) segments are respectively assumed to be Q2, Q3, and Q4. The hydrophobing agent condensation ratio is given by formula $(Q2\times2+Q3\times3+Q4\times4)/4\times(Q2+Q3+Q4)$.

The volume resistivity of the silica particles is, for example, $10^{11}$ Ω·cm or more, and may be $10^{12}$ Ω·cm or more or $10^{13}$ Ω·cm or more.

When the volume resistivity of the silica particles is within the above-described range, degradation of electrical properties is suppressed.

The volume resistivity of the silica particles is measured as follows. The measurement environment has a temperature of 20° C. and a humidity of 50% RH.

First, silica particles are separated from the layer. The separated silica particles which are the measurement object are placed on a surface of a circular jig equipped with a 20 $cm^2$ electrode plate in such a manner that the thickness of a layer formed by the silica particles is about 1 mm or more and about 3 mm or less. An identical 20 $cm^2$ electrode plate is placed on the silica particle layer so as to sandwich the silica particle layers with the electrode plates. In order to eliminate voids between the silica particles, a load of 4 kg is applied on the electrode plate placed on the silica particle layer and then the thickness (cm) of the silica particle layer is measured. The two electrode plates sandwiching the hydrophobic silica particle layer are connected to an electrometer and a high-voltage power generator. A high voltage is applied to the two electrodes so that a predetermined electric field is created and the value (A) of the current flowing at that time is measured to calculate the volume resistivity (Ω·cm) of the silica particles. The calculation formula for the volume resistivity (Ω·cm) of the silica particles is as follows:

$$\rho=E\times20/(I-I_0)/L$$

where ρ represents a volume resistivity (Ω·cm) of silica particles, E represents an applied voltage (V), I represents a current value (A), $I_0$ represents a current value (A) at an applied voltage of 0 V, and L represents a thickness (cm) of the silica particle layer. In evaluation, the volume resistivity at an applied voltage of 1,000 V is used.

The volume-average particle size of the inorganic particles containing silica particles is, for example, 20 nm or more and 200 nm or less, or may be 40 nm or more and 150 nm or less, 50 nm or more and 120 nm or less, or 50 nm or more and 110 nm or less.

When the volume-average particle size is within this range, cracking of the inorganic protective layer and generation of residual potential are easily suppressed.

The volume-average particle size of the inorganic particles is measured as follows. Although the description below concerns the measurement method for silica particles, the same measurement method may be applied to other particles as well.

The volume-average particle size of the silica particles is measured by separating silica particles from the layer, observing 100 primary particles of the silica particles with a scanning electron microscope (SEM) at a magnification of 40,000, measuring the longest axis and the shortest axis of each particle by image analysis of the primary particles, determining the equivalent circle diameter from the intermediate value, determining a 50% diameter (D50v) from the cumulative frequency of the obtained equivalent circle diameters, and assuming the result to be the volume-average particle size of the silica particles.

The inorganic particle content may be appropriately determined according to the type thereof. From the viewpoint of suppressing cracking of the inorganic protective layer and generation of residual potential, the inorganic particle content relative to the entire charge transporting layer may be 30% by weight or more, 40% by weight or more, 45% by weight or more, or 50% by weight or more.

The upper limit of the inorganic particle content is not particularly limited. From the viewpoint of ensuring properties of the charge transporting layer, the upper limit may be 70% by weight or less, 65% by weight or less, or 60% by weight or less.

The inorganic particle content may be larger than the charge transporting material content.

The charge transporting layer may contain known additives in addition to the above-described components.

Properties of Charge Transporting Layer

The surface roughness Ra (arithmetic average surface roughness Ra) of the inorganic protective layer-side surface of the charge transporting layer is, for example, 0.06 μm or less and may be 0.03 μm or less in some cases or 0.02 μm or less in some cases.

When the surface roughness Ra is within this range, the flatness and smoothness of the inorganic protective layer are improved and the cleaning property is improved.

The surface roughness Ra may be controlled to be in the above-described range by increasing the thickness of the layer, for example.

The surface roughness Ra is measured as follows.

First, the inorganic protective layer is separated and the layer to be measured is exposed. Then a portion of that layer is cut out with a cutter or the like to obtain a measurement sample.

The measurement sample is analyzed with a probe-type surface roughness meter (SURFCOM 1400A produced by TOKYO SEIMITSU CO., LTD.). The measurement conditions are in compliance with Japanese Industrial Standards (JIS) B 0601-1994, namely, evaluation length Ln=4 mm, sampling length L=0.8 mm, and cutoff value=0.8 mm.

The elastic modulus of the charge transporting layer is, for example, 5 GPa or more and may be 6 GPa or more in some cases and 6.5 GPa or more in some cases.

When the elastic modulus of the charge transporting layer is within this range, cracking of the inorganic protective layer is easily suppressed.

In order to adjust the elastic modulus of the charge transporting layer to be in the above-mentioned range, the silica particle size and/or silica particle content may be adjusted or the type and content of the charge transporting material may be adjusted, for example.

The elastic modulus of the charge transporting layer is measured as follows.

First, the inorganic protective layer is separated and the layer to be measured is exposed. Then a portion of that layer is cut out with a cutter or the like to obtain a measurement sample.

The measurement sample is analyzed with Nano Indenter SA2 produced by MTS Systems Corporation and a depth profile is obtained by a continuous stiffness measurement (CSM) (U.S. Pat. No. 4,848,141). The average of the values observed in the indentation depth range of 30 nm to 100 nm is used.

The thickness of the charge transporting layer is, for example, 10 μm or more and 40 μm or less, and may be 10 μm or more and 35 μm or less in some cases or 15 μm or more and 30 μm or less in some cases.

When the thickness of the charge transporting layer is within this range, cracking of the inorganic protective layer and generation of residual potential are easily suppressed.

Formation of Charge Transporting Layer

The charge transporting layer may be formed by any known method and no limitations are imposed. For example, a charge transporting layer-forming coating solution prepared by adding a solvent to the above-described components may be applied to form a coating film and the coating film may be dried and if needed heated.

Examples of the solvent used in preparing the charge transporting layer-forming coating solution include common organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic and straight-chain ethers such as tetrahydrofuran and ethyl ether. These solvents may be used alone or in combination as a mixture.

Examples of the technique of applying the charge transporting layer-forming coating solution to a charge generating layer include common techniques such as a blade coating technique, a wire bar coating technique, a spray coating technique, a dip coating technique, a bead coating technique, an air knife coating technique, and a curtain coating technique.

When particles (for example, silica particles or fluororesin particles) are to be dispersed in a charge transporting layer-forming coating solution, the dispersing method may use a medium disperser such as a ball mill, a vibrating ball mill, an attritor, a sand mill, or a horizontal sand mill, or a medium-less disperser such as an agitator, an ultrasonic disperser, a roll mill, or a high-pressure homogenizer, for example. Examples of the high-pressure homogenizers include collision-type homogenizers with which a dispersion is dispersed under a high pressure through liquid-liquid collision or liquid-wall collision, or a penetration-type homogenizer with which a material is caused to penetrate through narrow channels under a high pressure.

After formation of the charge transporting layer and before formation of the inorganic protective layer, a step of substituting air contained in the organic photosensitive layer on the conductive substrate with gas having a higher oxygen concentration than the air may be performed as needed.

Inorganic Protective Layer

Composition of Inorganic Protective Layer

The inorganic protective layer is a layer that contains an inorganic material.

Examples of the inorganic material include oxide-based, nitride-based, carbon-based, and silicon-based inorganic materials, which have mechanical strength and a light transmitting property needed as the protective layer.

Examples of the oxide-based inorganic materials include metal oxides such as gallium oxide, aluminum oxide, zinc oxide, titanium oxide, indium oxide, tin oxide, and boron oxide, and mixed crystals of the foregoing.

Examples of the nitride-based inorganic materials include metal nitrides such as gallium nitride, aluminum nitride, zinc nitride, titanium nitride, indium nitride, tin nitride, and boron nitride, and mixed crystals of the foregoing.

Examples of the carbon-based and silicon-based inorganic materials include diamond-like carbon (DLC), amorphous carbon (a-C), hydrogenated amorphous carbon (a-C:H), hydrogenated and fluorinated amorphous carbon (a-C:H:F), amorphous silicon carbide (a-SiC), hydrogenated amorphous silicon carbide (a-SiC:H), amorphous silicon (a-Si), and hydrogenated amorphous silicon (a-Si:H).

The inorganic material may be a mixed crystal of oxide- and nitride-based inorganic materials.

Among these, metal oxides have excellent mechanical strength and light-transmitting property. Metal oxides also have an n-conductivity type and excellent conduction controllability. Thus, metal oxides may be used as the inorganic material. In particular, oxides of group 13 elements (such as gallium oxide) may be used.

The inorganic protective layer exhibits improved water repellency when it contains a group 13 element (for example, gallium) and oxygen. When water repellency is high, corona products trapped in the metal soap particles (or film products thereof) attached to the photoreceptor surface (surface of the inorganic protective layer) are easily removed by a cleaning blade.

As a result, when the inorganic protective layer contains a group 13 element (such as gallium) and oxide, occurrence of image deletion in a high-temperature, high-humidity environment is more easily suppressed.

In view of the above, the inorganic protective layer is to contain at least a group 13 element (for example, gallium) and oxygen, and, if needed, hydrogen. When hydrogen is contained, various physical properties of the inorganic protective layer containing at least a group 13 element (for example, gallium) and oxygen are easily controlled. For example, when an inorganic protective layer contains gallium, oxygen, and hydrogen (for example, an inorganic protective layer formed of gallium oxide containing hydrogen), the volume resistivity can be easily controlled within the range of $10^9$ Ω·cm or more and $10^{14}$ Ω·cm or less by varying the compositional ratio [O]/[Ga] in the range of 1.0 to 1.5.

The inorganic protective layer may contain, in addition to the inorganic material described above, at least one element selected from C, Si, Ge, and Sn to control the conductivity type to n-type or at least one element selected from N, Be, Mg, Ca, and Sr to control the conductivity type to p-type.

When the inorganic protective layer contains gallium, oxygen, and optionally hydrogen, the element constitutional ratios may be as follows from the viewpoints of excellence in mechanical strength, light-transmitting property, flexibility, and conduction controllability.

The gallium constitutional ratio relative to all constitutional elements of the inorganic protective layer may be, for example, 15 atom % or more and 50 atom % or less, 20 atom % or more and 40 atom % or less, or 20 atom % or more and 30 atom % or less.

The oxygen constitutional ratio relative to all constitutional elements of the inorganic protective layer may be 30 atom % or more and 70 atom % or less, 40 atom % or more and 60 atom % or less, or 45 atom % or more and 55 atom % or less.

The hydrogen constitutional ratio relative to all constitutional elements of the inorganic protective layer may be 10 atom % or more and 40 atom % or less, 15 atom % or more and 35 atom % or less, or 20 atom % or more and 30 atom % or less.

The atomic number ratio (oxygen/gallium) may be more than 1.50 and 2.20 or less or may be 1.6 or more and 2.0 or less.

The element constitutional ratios of the respective elements in the inorganic protective layer, the atomic number ratio, distributions in the thickness direction, etc., are determined by Rutherford backscattering (hereinafter, "RBS").

In RBS, 3SDH Pelletron produced by National Electrostatics Corporation (NEC) is used as an accelerator, RBS-400 (produced by CE&A Co., Ltd.) is used as an endstation, and 3S-R10 is used as a system. A HYPRA program produced by CE&A Co., Ltd., and the like are used in the analysis.

The RBS measurement conditions are as follows: He++ ion beam energy: 2.275 eV, detection angle: 160°, grazing angle relative to incident beam: about 109°.

RBS measurement is conducted as follows.

First, a He++ ion beam is applied perpendicular to the sample and a detector is positioned at an angle of 160° with respect to the ion beam to measure the signals of backscattered He. The energy and strength of the detected He determine the compositional ratio and the film thickness. The spectrum may be measured at two detection angles in order to improve accuracy of determining the compositional ratio and film thickness. Conducting measurement at two detection angles having different depth-direction resolution and backscattering dynamics and performing cross-checking improve accuracy.

The number of the He atoms backscattered by the target atoms is determined only from the three factors, namely, 1) the atomic number of the target atom, 2) energy of He atoms before scattering, and 3) scattering angle.

The density is predicted from the detected composition through calculation and the thickness is determined by using the density. The margin of error in determining the density is within 20%.

The hydrogen ratio is determined as follows by hydrogen forward scattering (hereinafter referred to as "HFS").

In HFS measurement, 3SDH Pelletron produced by National Electrostatics Corporation (NEC) is used as an accelerator, RBS-400 produced by CE&A Co., Ltd., is used as an endstation, and 3S-R10 is used as a system. A HYPRA program produced by CE&A Co., Ltd., and the like are used in the analysis. The HFS measurement conditions are as follows: He++ ion beam energy: 2.275 eV, detection angle: 160°, and grazing angle with respect to incident beam: 30°.

In the HFS measurement, the detector is positioned at 30° with respect to the He++ ion beam and the sample is positioned at 75° with respect to the normal line so as to pick up signals of hydrogen scattered forward out of the sample. During this process, the detector may be covered with an aluminum foil to remove the He atoms scattering with hydrogen. Quantitative determination is conducted by normalizing the hydrogen counts of the reference samples and the measured sample by a stopping power and then comparing the normalized counts. A sample formed of Si and H ion-implanted in Si and white mica are used as the reference samples.

White mica is known to have a hydrogen concentration of 6.5 atom %.

The hydrogen count is corrected by subtracting the number of H atoms adhering to the clean Si surface, for example, so as to count out H adhering to the outermost surface.

Properties of Inorganic Protective Layer

The inorganic protective layer may have a compositional ratio distribution in the thickness direction or may have a multilayer structure depending on the purpose.

The inorganic protective layer may be a non-single-crystal film such as a microcrystalline film, a polycrystalline film, or an amorphous film. An amorphous film may be used since it has a smooth and flat surface or a microcrystalline may be used from the viewpoint of hardness.

A growth section of the inorganic protective layer may have a columnar structure. From the viewpoint of slidability, the growth section may have a highly flat structure and thus may be amorphous.

Crystallinity and amorphousness are determined by the presence or absence of spots and lines in diffraction diagrams obtained by reflection high energy electron diffraction (RHEED) measurement.

The volume resistivity of the inorganic protective layer is, for example, $10^6$ Ω·cm or more and may be $10^8$ Ω·cm or more.

When the volume resistivity is within this range, charges rarely flow in the surface direction and electrostatic latent images are formed smoothly.

The volume resistivity is determined by measuring the resistance values with LCR meter ZM2371 produced by NF Corporation at a frequency of 1 kHz and a voltage of 1 V and calculating the volume resistivity from the measured resistance value, the electrode area, and the sample thickness.

The measurement sample may be a sample prepared by depositing a layer on an aluminum substrate under the same conditions as those for forming the inorganic protective layer to be measured and forming a gold electrode on the deposited layer by vacuum vapor deposition. Alternatively, the measurement sample may be a sample prepared by separating the inorganic protective layer from an already prepared electrophotographic photoreceptor, partly etching the separated inorganic protective layer, and sandwiching the etched inorganic protective layer between a pair of electrodes.

The elastic modulus of the inorganic protective layer is 30 GPa or more and 80 GPa or less and may be 40 GPa or more and 65 GPa or less. When the elastic modulus is within this range, generation of nicks (dents), cracking, and separation in the inorganic protective layer are likely to be suppressed.

The elastic modulus is determined by using Nano Indenter SA2 produced by MTS Systems Corporation by continuous stiffness measurement (CSM) (U.S. Pat. No. 4,848,141) to obtain a depth profile, and calculating the average from the values observed at an indent depth of 30 nm to 100 nm. The measurement conditions are as follows:

Measurement environment: 23° C., 55% RH

Indenter used: regular triangle pyramid indenter made of diamond (Berkovich indenter)

Testing mode: CSM mode

The measurement sample may be a sample prepared by forming a film on a substrate under the same conditions as those for forming the inorganic protective layer to be measured, or may be a sample prepared by separating the inorganic protective layer from an already prepared electrophotographic photoreceptor and partially etching the separated inorganic protective layer.

The thickness of the inorganic protective layer is, for example, 0.2 μm or more and 10.0 μm or less or may be 0.4 μm or more and 5.0 μm or less.

When the thickness is within this range, generation of nicks (dents), cracking, and separation of the inorganic protective layer are likely to be suppressed.

Formation of Inorganic Protective Layer

Examples of the technique used to form a protective layer include commonly employed vapor phase film-forming techniques such as a plasma chemical vapor deposition (CVD) technique, an metal organic chemical vapor deposition technique, a molecular beam epitaxy technique, vapor deposition, and sputtering.

Formation of an inorganic protective layer is described below as a specific example while describing an example of a film forming device through the drawings. Although the description below concerns the method for forming an inorganic protective layer that contains gallium, oxygen, and hydrogen, the method is not limited to this. Any common method may be employed depending on the intended composition of the inorganic protective layer.

Figure 6A:
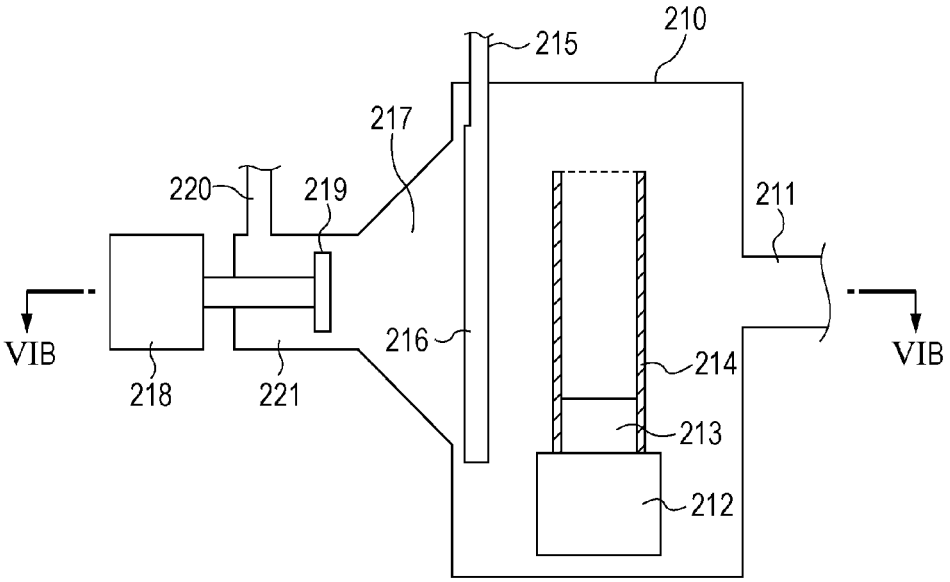
FIGS. 6A and 6B are schematic diagrams illustrating a film forming device used to form an inorganic protective layer of the electrophotographic photoreceptor according to the exemplary embodiment.
Figure 6B:
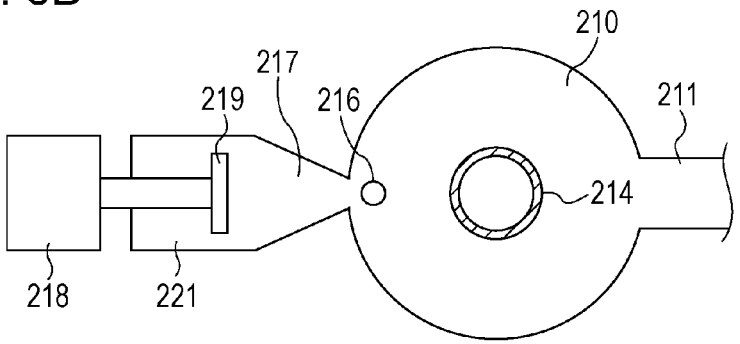

FIGS. 6A and 6B are each a schematic diagram of an example of a film forming device used in forming an inorganic protective layer of an electrophotographic photoreceptor according to the exemplary embodiment. FIG. 6A is a schematic cross-sectional view of the film forming device as viewed from one side, and FIG. 6B is a schematic cross-sectional view of the film forming device taken along line VIB-VIB in FIG. 6A. In FIGS. 6A and 6B, reference numeral 210 denotes a deposition chamber, 211 denotes an exhaust, 212 denotes a substrate rotating unit, 213 denotes a substrate supporting unit, 214 denotes a substrate, 215 denotes a gas inlet duct, 216 denotes a shower nozzle having an opening through which gas introduced from the gas inlet duct 215 is injected, 217 denotes a plasma diffusing unit, 218 denotes a high-frequency power supply unit, 219 denotes a plate electrode, 220 denotes a gas inlet duct, and 221 denotes a high-frequency discharge tube.

In the film forming device illustrated in FIGS. 6A and 6B, the exhaust 211 connected to a vacuum evacuator not illustrated in the drawing is provided at one end of the deposition chamber 210. A plasma generator that includes the high-frequency power supply unit 218, the plate electrode 219, and the high-frequency discharge tube 221 is provided to the deposition chamber 210 on the side opposite to where the exhaust 211 is installed.

This plasma generator is constituted by the high-frequency discharge tube 221, the plate electrode 219 installed within the high-frequency discharge tube 221 and having a discharge surface positioned on the exhaust 211 side, and the high-frequency power supply unit 218 disposed outside the high-frequency discharge tube 221 and connected to a surface of the plate electrode 219 opposite of the discharge surface. The gas inlet duct 220 through which gas is supplied to the interior of the high-frequency discharge tube 221 is connected to the high-frequency discharge tube 221, and the other end of the gas inlet duct 220 is connected to a first gas supply source not illustrated in the drawings.

Figure 7:
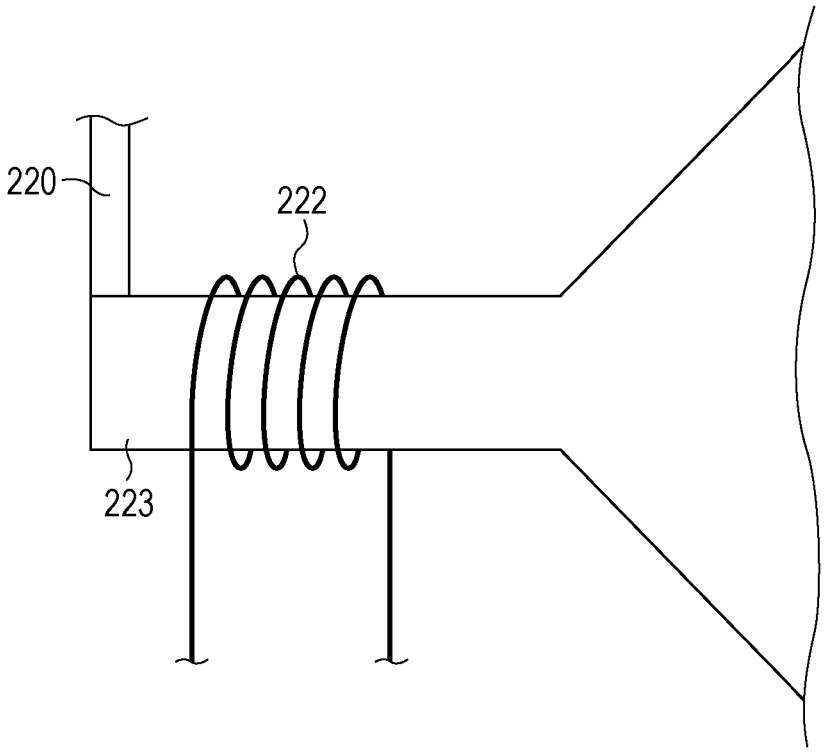
FIG. 7 is a schematic diagram illustrating a plasma generator used in forming the inorganic protective layer of the electrophotographic photoreceptor according to the exemplary embodiment.

Instead of the plasma generator in the film forming device illustrated in FIGS. 6A and 6B, a plasma generator illustrated in FIG. 7 may be used. FIG. 7 is a schematic diagram illustrating another example of the plasma generator used in the film forming device illustrated n FIGS. 6A and 6B. FIG. 7 is a side view of the plasma generator. In FIG. 7, reference numeral 222 denotes a high-frequency coil, 223 denotes a quartz tube, and 220 is the same as the one illustrated in FIGS. 6A and 6B. The plasma generator includes the quartz tube 223 and the high-frequency coil 222 disposed along the outer peripheral surface of the quartz tube 223. One end of the quartz tube 223 is connected to the deposition chamber 210 (not illustrated in FIG. 7). The other end of the quartz tube 223 is connected to the gas inlet duct 220 through which gas is introduced to the interior of the quartz tube 223.

Referring to FIGS. 6A and 6B, the shower nozzle 216 having a rod shape and extending along the discharge surface of the plate electrode 219 is connected to the discharge surface side of the plate electrode 219, and one end of the shower nozzle 216 is connected to the gas inlet duct 215. The gas inlet duct 215 is connected to a second gas supply source (not illustrated in the drawings) disposed outside the deposition chamber 210.

The substrate rotating unit 212 is installed in the deposition chamber 210. The substrate 214 has a cylindrical shape and is loadable onto the substrate rotating unit 212 through the substrate supporting unit 213 so that the substrate 214 faces the shower nozzle 216 in such a manner that the longitudinal direction of the shower nozzle 216 coincides with the axial direction of the substrate 214. During film deposition, the substrate rotating unit 212 rotates so as to turn the substrate 214 in the circumferential direction. An example of the substrate 214 is a photoreceptor that includes layers up to an organic photosensitive layer formed in advance.

The inorganic protective layer is formed as follows, for example.

First, oxygen gas (or helium (He)-diluted oxygen gas), helium (He) gas, and optionally hydrogen ($H_2$) gas are introduced to the interior of the high-frequency discharge tube 221 through the gas inlet duct 220, and at the same time, a 13.56 MHz radio wave is supplied to the plate electrode 219 from the high-frequency power supply unit 218. During this process, the plasma diffusing unit 217 that spreads radially from the discharge surface side of the plate electrode 219 toward the exhaust 211 is formed. The gas introduced from the gas inlet duct 220 flows in the deposition chamber 210 from the plate electrode 219 side toward the exhaust 211 side. The plate electrode 219 may be surrounded by an earth shield.

Next, trimethyl gallium gas is introduced into the deposition chamber 210 through the gas inlet duct 215 and the shower nozzle 216 located downstream of the plate electrode 219, which serves as an activating unit, so as to form a non-single-crystal film containing gallium, oxygen, and hydrogen on the surface of the substrate 214.

For example, a substrate on which an organic photosensitive layer is formed is used as the substrate 214.

The temperature of the surface of the substrate 214 during deposition of the inorganic protective layer is 150° C. or lower, may be 100° C. or lower in some cases, or may be 30° C. to 100° C. in some cases since an organic photoreceptor having an organic photosensitive layer is used.

Even if the temperature of the surface of the substrate 214 is 150° C. or lower at the beginning of the deposition, the temperature may become higher than 150° C. due to the effect of the plasma. In such a case, the organic photosensitive layer may be damaged by heat. Thus, the surface temperature of the substrate 214 is to be controlled by taking into account this effect.

The temperature of the surface of the substrate 214 may be controlled by using at least one of a heating device and a cooling device (not illustrated in the drawings) or may be left to naturally increase as a result of discharge. In the case where the substrate 214 is heated, a heater may be installed on the outer side or inner side of the substrate 214. In the case where the substrate 214 is cooled, gas or liquid for cooling may be provided to circulate on the inner side of the substrate 214.

In the case where the increase in temperature of the surface of the substrate 214 caused by discharge is to be avoided, the increase may be effectively avoided by adjusting the high-energy gas flow applied to the surface of the substrate 214. In such a case, the conditions such as gas flow rate, discharge output, and pressure are adjusted so that the intended temperature is obtained.

Instead of trimethyl gallium gas, an organic metal compound containing aluminum or a hydride such as diborane may be used. Two or more of these may be used as a mixture. For example, in the initial stage of forming an inorganic protective layer, trimethyl indium may be introduced into the deposition chamber 210 through the gas inlet duct 215 and the shower nozzle 216 so as to form a film containing nitrogen and indium on the substrate 214. In such a case, this film absorbs ultraviolet rays that are generated during the subsequent film deposition and that deteriorate the organic photosensitive layer. As a result, damage onto the organic photosensitive layer inflicted by generation of ultraviolet rays during film deposition is suppressed.

In order to perform doping with a dopant during film deposition, $SiH_3$ or $SnH_4$ in a gas state is used for n-type doping, and biscyclopentadienylmagnesium, dimethyl calcium, dimethyl strontium, or the like in a gas state is used for p-type doping. In order to dope the surface layer with dopant atoms, a commonly used technique, such as a thermal diffusion technique or an ion implantation technique, may be employed.

Specifically, for example, gas containing at least one dopant atoms is introduced into the deposition chamber 210 through the gas inlet duct 215 and the shower nozzle 216 so as to obtain an inorganic protective layer having a particular conductivity type such as n-type or p-type.

In the film forming device illustrated in FIGS. 6A, 6B, and 7, active nitrogen or active hydrogen formed by discharge energy may be independently controlled by providing plural activating devices. Alternatively, gas simultaneously containing nitrogen atoms and hydrogen atoms, such as $NH_3$ may be used. Furthermore, $H_2$ may be added. Conditions that generate free active hydrogen from the organic metal compound may be employed.

As a result, activated carbon atoms, gallium atoms, nitrogen atoms, hydrogen atoms, and the like are present on the surface of the substrate 214 in a controlled manner. The activated hydrogen atoms have an effect of inducing desorption of hydrogen atoms in a molecular form from hydrocarbon groups such as methyl and ethyl groups constituting the organic metal compound. Thus, a hard film (inorganic protective layer) constituting three-dimensional bonds is formed.

The plasma generator of the film forming device illustrated in FIGS. 6A, 6B, and 7 uses a high-frequency oscillator; however, the plasma generator is not limited to this. For example, a microwave oscillator, an electrocyclotron resonance plasma source, or a helicon plasma source may be used. The high-frequency oscillator may be of an induction type or a capacitance type.

Two or more of these devices of different types may be used in combination, or two or more devices of the same type may be used in combination. A high-frequency oscillator may be used to suppress the increase in temperature of the surface of the substrate 214. Alternatively, a device that suppresses heat radiation may be provided.

In the case where two or more plasma generators of different types are used, adjustment may be made so that discharge is induced simultaneously at the same pressure. There may be a difference in pressure between the region where discharge is conducted and the region where deposition is conducted (region where the substrate is loaded). These devices may be arranged in series relative to the gas flow that flows from the portion where the gas is introduced to the portion where the gas is discharged in the film forming device. Alternatively, the devices may be arranged so that all of the devices face the deposition surface of the substrate.

For example, when two types of plasma generators are arranged in series relative to the gas flow in a film forming device illustrated in FIGS. 6A and 6B, the shower nozzle 216 serves as an electrode and is used as a second plasma generator that induces discharge in the deposition chamber 210. In such a case, for example, a high-frequency voltage is applied to the shower nozzle 216 through the gas inlet duct 215 so that discharge occurs in the deposition chamber 210 by using the shower nozzle 216 as an electrode. Alternatively, instead of using the shower nozzle 216 as an electrode, a cylindrical electrode is provided between the substrate 214 and the plate electrode 219 in the deposition chamber 210 and the cylindrical electrode is used to induce discharge in the deposition chamber 210. In the case where two different types of plasma generators are used at the same pressure, for example, when a microwave oscillator and a high-frequency oscillator are used, the excitation energies of the excitation species are markedly changed, which is effective for controlling the quality of the film. Discharge may be conducted at about an atmospheric pressure (70,000 Pa or more and 110,000 Pa or less). Helium (He) may be used as carrier gas in conducting discharge at about atmospheric pressure.

The inorganic protective layer is formed by, for example, placing a substrate 214, on which an organic photosensitive layer is formed, in the deposition chamber 210 and introducing mixed gas of different compositions to form an inorganic protective layer.

In the case where high-frequency discharge is to be conducted, for example, the frequency may be adjusted to be in the range of 10 kHz or more and 50 MHz or less in order to form a high-quality film at low temperature. The output depends on the size of the substrate 214 and may be in the range of 0.01 $W/cm^2$ or more and 0.2 $W/cm^2$ or less relative to the surface area of the substrate. The rotation speed of the substrate 214 may be in the range of 0.1 rpm or more and 500 rpm or less.

In the description above, an example of an electrophotographic photoreceptor in which the photosensitive layer is a separated function-type organic photosensitive layer and the charge transporting layer is of a single layer type is described. In the case of the electrophotographic photoreceptor illustrated in FIG. 4 (the photosensitive layer is a separated function-type organic photosensitive layer and the charge transporting layer is of a multilayer type), the charge transporting layer 3A in contact with the inorganic protective layer 5 may have the same structure as the charge transporting layer 3 of the electrophotographic photoreceptor illustrated in FIG. 3 and the charge transporting layer 3B not in contact with the inorganic protective layer 5 may have the same structure as a typical charge transporting layer.

When the charge transporting layer 3A contains inorganic particles, the upper limit and lower limit of the inorganic particle content in the charge transporting layer 3A may be the same as those of the charge transporting layer 3.

The thickness of the charge transporting layer 3A may be 1 μm or more and 15 μm or less. The thickness of the charge transporting layer 3B may be 15 μm or more and 29 μm or less.

In the case of the electrophotographic photoreceptor illustrated in FIG. 5 (example in which the photosensitive layer is an a single-layer-type organic photosensitive layer), the single-layer-type organic photosensitive layer 6 (charge generating/charge transporting layer) may have the same structure as the charge transporting layer 3 of the electrophotographic photoreceptor except for incorporation of the charge generating material.

The amount of the charge generating material in the single-layer-type organic photosensitive layer 6 may be 25% by weight or more and 50% by weight or less relative to the entire single-layer-type organic photosensitive layer. When the single-layer-type organic photosensitive layer 6 contains inorganic particles, the upper limit and the lower limit of the inorganic particle content in the single-layer-type organic photosensitive layer 6 may be the same as those of the charge transporting layer 3.

The thickness of the single-layer-type organic photosensitive layer 6 may be 15 μm or more and 30 μm or less.

Charging Device

Examples of the charging device 8 include contact-type chargers that use conductive or semi-conductive charging rollers, charging brushes, charging films, charging rubber blades, and charging tubes; and non-contact-type chargers known in the art such as non-contact-type roller chargers and scorotron chargers and corotron chargers that use corona discharge.

Exposing Device

An example of the exposing device 9 is an optical device that illuminates the surface of the electrophotographic photoreceptor 7 by light from a semiconductor laser, an LED, or a liquid crystal shutter so as to form an intended light image on the surface. The wavelength of the light source is to be within the region of the spectral sensitivity of the electrophotographic photoreceptor. The mainstream semiconductor lasers are infrared lasers having an oscillation wavelength around 780 nm. The wavelength is not limited to this, and a laser that has an oscillation wavelength on the order of 600 nm or a blue laser that has an oscillation wavelength of 400 nm or more and 450 nm or less may also be used. A surface-emission type laser light source capable of outputting a multibeam is effective for forming color images.

Developing Device

An example of the developing device 11 is a typical developing device that conducts development by using a developer in a contact or non-contact manner. The developing device 11 may be any device that has this function and is selected according to the purpose. An example thereof is a known developing device that has a function of causing a one-component or two-component developer to attach to the electrophotographic photoreceptor 7 by using a brush, a roller, or the like. In particular, the developing device may use a development roller that retains the developer on the surface thereof.

The developer used in the developing device 11 may be a one-component developer formed of a toner alone or may be a two-component developer formed of a toner and a carrier. The developer may be magnetic or non-magnetic. Known developers may be used as the developer.

The developer is described below.

The developer may be any developer containing a toner that has at least toner particles.

Examples of the developer include developers that contain common color toners, developers that contain colorless (transparent) toners, and developers that contain glitter toners. A developer that contains a common color toner is described in detail below as a representative example.

Toner Particles

Toner particles contain, for example, a binder resin and, if needed, a coloring agent, a releasing agent, and additives.

Binder Resin

Specific examples of the binder resin include homopolymers of monomers such as styrenes (for example, styrene, parachlorostyrene, α-methylstyrene, etc.), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, etc.), ethylenically unsaturated nitriles (for example, acrylonitrile, methacrylonitrile, etc.), vinyl ethers (for example, vinyl methyl ether, vinyl isobutyl ether, etc.), vinyl ketones (vinyl methyl ketone, vinyl ethyl ketone, vinyl isopropenyl ketone, etc.), and olefins (for example, ethylene, propylene, butadiene, etc.); and vinyl resins formed of copolymers prepared from two or more of these monomers.

Other examples of the binder resin include non-vinyl resins such as epoxy resins, polyester resins, polyurethane resins, polyamide resins, cellulose resins, polyether resins, and modified rosin; mixtures of non-vinyl resins and vinyl resins; and graft polymers obtained by polymerizing vinyl monomers in the presence of the non-vinyl resins.

These binder resins may be used alone or in combination.

From the viewpoint of removing corona products attached to the surface of the electrophotographic photoreceptor 7 by scrubbing with the toner reservoir, the binder resin may be a polyester resin or a styrene acrylic resin among these.

The binder resin content relative to the entire toner particles, for example, may be 40% by weight or more and 95% by weight or less, 50% by weight or more and 90% by weight or less, or 60% by weight or more and 85% by weight or less.

Coloring Agent

Examples of the coloring agent used in the exemplary embodiment include pigments such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate, and dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These coloring agents may be used alone or in combination.

The coloring agent may be a surface-treated coloring agent or may be used in combination with a dispersing agent, if needed. Two or more coloring agents may be used in combination.

The coloring agent content relative to the entire toner particles is, for example, 1% by weight or more and 30% by weight or less or may be 3% by weight or more and 15% by weight or less.

Releasing Agent

Examples of the releasing agent include, but are not limited to, hydrocarbon wax; natural wax such as carnauba wax, rice wax, and candelilla wax; synthetic or mineral or petroleum wax such as montan wax; and ester wax such as fatty acid esters and montanic acid esters.

The releasing agent content relative to the entire toner particles may be, for example, 1% by weight or more and 20% by weight or less or 5% by weight or more and 15% by weight or less.

Other Additives

Examples of other additives include known additives such as magnetic materials, charge controllers, and inorganic powder. These additives are internal additives and contained inside the toner particles.

Properties and Other Features of Toner Particles

The toner particles may be toner particles having a single-layer structure or core-shell toner particles each including a core (core particle) and a coating layer (shell layer) that covers the core.

Core-shell toner particles may include a core containing a binder resin and, optionally, a coloring agent and other additives such as a releasing agent and a coating layer that contains a binder resin, for example.

The volume-average particle size (D50v) of the toner particles may be 2 μm or more and 10 μm or less or may be 4 μm or more and 8 μm or less.

Various average particle sizes and particle size distribution indices of the toner particles are measured with Coulter Multisizer II (produced by Beckman Coulter, Inc.) with ISOTON-II (produced by Beckman Coulter, Inc.) as an electrolyte.

In measurement, 0.5 mg or more and 50 mg or less of a measurement sample is added to 2 mL of a 5% aqueous solution of a surfactant (for example, sodium alkylbenzenesulfonate) serving as a dispersing medium. The resulting solution is added to 100 mL or more and 150 mL or less of the electrolyte.

The electrolyte containing the suspended sample is dispersed for 1 minute with an ultrasonic disperser and the particle size distribution of the particles having particle size in the range of 2 μm or more and 60 μm or less is measured with Coulter Multisizer II with 100 μm apertures. The number of particles sampled is 50,000.

With respect to the particle size ranges (channels) divided based on the observed particle size distribution, cumulative distributions are plotted for the volume and the number of particles in the ascending order of the diameter. The particle diameters below which 16% of particles are included are assumed to be the volume particle size D16v and number particle size D16p. The particle diameters below which 50% of particles are included are assumed to be the volume-average particle size D50v and number-average particle size D50p. The diameters below which 84% of particles are included are assumed to be the volume particle size D84v and number particle size D84p.

By using these values, the volume particle size distribution index (GSDv) is calculated as $(D84v/D16v)^{1/2}$, and the number particle size distribution index (GSDp) is calculated as $(D84p/D16p)^{1/2}$.

The average circularity of the toner particles may be 0.94 or more and 1.00 or less or may be 0.95 or more and 0.98 or less.

The average circularity of the toner particles is determined by (length of circumference of equivalent circle)/(length of circumference [(length of circumference of circle having the same projection area as the particle image)/(length of circumference of projected image of particle)]. Specifically, it is the value measured by the following method.

First, toner particles to be analyzed are sampled by suction and are induced to form a flat flow. Then a particle image is captured as a still image by irradiating the flat flow instantaneously with a strobe and the particle image is analyzed with a flow-type particle image analyzer (FPIA-2100 produced by Sysmex Corporation). The number of particles to be sampled in determining the average circularity is 3500.

When the toner has an external additive, the toner particles are obtained by dispersing the toner (developer) to be measured in water containing a surfactant and then subjecting the resulting dispersion to an ultrasonic treatment to remove the external additive.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles that serve as an external additive may be subjected to a hydrophobing treatment. The hydrophobing treatment is conducted by immersing inorganic particles in a hydrophobing agent, for example. The hydrophobing agent may be any. Examples thereof include silane coupling agents, silicone oil, titanate coupling agents, and aluminum coupling agents. These may be used alone or in combination.

The amount of the hydrophobing agent used is typically 1 part by weight or more and 10 parts by weight or less relative to 100 parts by weight of the inorganic particles, for example.

Other examples of the external additive include resin particles (resin particles of polystyrene, polymethyl methacrylate (PMMA), melamine resins, etc.) and cleaning active agents (for example, particles of metal salts of higher fatty acids such as zinc stearate and particles of fluorine-based polymers).

The amount of the external additive relative to the toner particles may be, for example, 0.01% by weight or more and 5% by weight or less or may be 0.01% by weight or more and 2.0% by weight or less.

Method for Producing Toner

A method for producing a toner according to the exemplary embodiment will now be described.

The toner according to the exemplary embodiment is obtained by first forming toner particles and then externally adding an external additive to the toner particles.

The toner particles may be produced by a dry method (for example, a kneading and pulverizing method) or a wet method (for example, an aggregation and uniting method, a suspension polymerization method, or a dissolution suspension method). The toner particles may be made by any known process.

Among these methods, an aggregation and uniting method may be used to obtain toner particles.

Specifically, when toner particles are to be produced by an aggregation and uniting method, the method includes a step of preparing a resin particle dispersion by dispersing resin particles that serve as a binder resin (resin particle dispersion preparation step), a step of forming aggregated particles by causing the resin particles (and other particles if needed) to aggregate in the resin particle dispersion (or in a dispersion after another particle dispersion is added if needed) so as to form aggregated particles (aggregated particle forming step), and a step of forming toner particles by heating the resulting aggregated particle dispersion containing dispersed aggregated particles so as to fuse and unite the aggregated particles (fusing and uniting step).

The toner according to the exemplary embodiment is, for example, produced by adding an external additive to the obtained dry toner particles and mixing the resulting mixture. Mixing may be conducted by using a V blender, a Henschel mixer, a Loedige mixer, or the like. If needed, a vibrating screen, an air screen, or the like may be used to remove coarse particles of the toner.

Developer

When the developer is a two-component developer, the carrier may be any known carrier. Examples of the carrier include a coated carrier prepared by covering the surface of a magnetic powder core with a coating resin, a magnetic powder-dispersed carrier prepared by dispersing and distributing magnetic powder in a matrix resin, and a resin-impregnated carrier prepared by impregnating porous magnetic powder with a resin.

The magnetic powder-dispersed carrier and the resin-impregnated carrier may each be a carrier prepared by covering a core formed of the particle that constitutes that carrier with a coating resin.

The mixing ratio (weight ratio) of the toner to the carrier in the two-component developer (toner:carrier) may be 1:100 to 30:100 or may be 3:100 to 20:100.

Cleaning Device

A cleaning blade-type system equipped with the cleaning blade 131 is used as the cleaning device 13.

In addition to the cleaning blade system, a fur brush cleaning system or development-cleaning simultaneous system may be used in combination.

The tensile elastic modulus of the cleaning blade 131 is, for example, 20 MPa or more and 4,000 MPa or less and may be 40 MPa or more and 3,000 MPa or less in some cases and 60 MPa or more and 2,500 MPa or less in some cases.

The tensile elastic modulus is measured in accordance with JIS K 7161 by using INSTRON 5566 (produced by TOYO SEIKI SEISAKU-SHO, Ltd.) with a strip-shaped sample specimen (6 mm in width, 130 mm in length, No. 1 dumbbell specimen) at a testing speed of 500 mm/min with sampling number n=5.

Intercepting Device

The intercepting device 15 includes an intercepting member 151 that intercepts the toner particles remaining on the surface 72 of the electrophotographic photoreceptor 7 after transfer of the toner image.

As illustrated in FIG. 2, the intercepting member 151 is separated from the surface 72 of the electrophotographic photoreceptor 7 by a gap. A gap 157 is formed between a portion 153 of the intercepting member 151 opposing the electrophotographic photoreceptor 7 and the surface 72 of the electrophotographic photoreceptor 7. The gap distance L between the intercepting member 151 and the surface 72 is 0.3 to 0.9 (inclusive) times the volume-average particle size of the toner particles of the toner housed in the developing device 11. In other words, the intercepting member 151 is arranged and fixed by a fixing device not shown in the drawing so that the gap distance L is within the above-mentioned range. Because the gap distance L is within this range, a surface 152 of the intercepting member 151 which faces the upstream side in the rotation direction of the electrophotographic photoreceptor 7 intercepts the toner particles that cannot pass through the gap 157 and the toner particles accumulate, forming a toner reservoir. As the quantity of the toner reservoir becomes excessively large, the pressure causes a portion of the toner reservoir to pass through the gap 157 and the quantity of the toner reservoir is maintained at an appropriate level.

In other words, because the gap distance L is within the above-described range, the toner particles are easily intercepted and a toner reservoir is easily formed compared to when the gap distance L is beyond the described range. Thus, the toner reservoir scrubs the surface 72 of the electrophotographic photoreceptor 7 and corona products on the surface 72 are easily removed. Therefore, occurrence of image deletion in a high-temperature, high-humidity environment is suppressed.

Furthermore, because the gap distance L is within the above-described range, the quantity of the toner reservoir is easily maintained at an appropriate level compared to when the gap distance L is below the above-described range. Thus, the removability of corona products on the surface 72 of the electrophotographic photoreceptor 7 is maintained and contamination inside the machine caused by overflow of the toner particles from the intercepting device 15 is suppressed.

From the viewpoint of facilitating formation of the toner reservoir and maintaining an appropriate quantity of the reservoir, the gap distance L is to be 0.3 to 0.9 times (inclusive) the volume-average particle size of the toner particles. The gap distance L may be 0.4 to 0.8 or about 0.4 to 0.8 (inclusive) times or 0.5 to 0.7 or about 0.5 to 0.7 (inclusive) times the volume-average particle size of the toner particles.

The volume-average particle size of the toner particles is determined by the method described above.

In the image forming apparatus illustrated in FIGS. 1 and 2, the surface 152 of the intercepting member 151 faces upward in the direction of gravitational force. However, the arrangement is not limited to this. Note that because the surface 152 faces upward in the direction of gravitational force, the toner reservoir is easily formed and corona products are easily removed by scrubbing with the toner reservoir compared to the case in which the surface of the intercepting member that intercepts the toner particles faces downward in the direction of gravitational force.

The intercepting member 151 illustrated in FIG. 2 has a flat surface 152. However, the surface of the intercepting member that intercepts the toner particles may be any surface capable of intercepting the toner particles and extending from one end to the other end in the axis direction of the electrophotographic photoreceptor 7. The surface 152 may have protrusions and recesses (for example, incisions) or may be a protruding or recessed curved surface.

Although the shape of the intercepting member 151 illustrated in FIG. 2 is plate, the shape is not limited to this and may be any as long as the surface that intercepts the toner particles extends from one end to the other end in the axis direction of the electrophotographic photoreceptor 7. For example, the shape may be triangular prism, columnar, crescent, or warped plate.

The material for the intercepting member 151 is not particularly limited. Examples thereof include resins (for example, polyurethane, polycarbonate, polystyrene, polyether, and polyester) and aluminum.

Transfer Device

Examples of the transfer device 40 include various known transfer chargers such as contact-type transfer chargers that use a belt, a roller, a film, a rubber blade, or the like, and scorotron transfer charges and corotron transfer chargers that utilize corona discharge.

Intermediate Transfer Body

Examples of the intermediate transfer body 50 include belt-shaped intermediate transfer bodies (intermediate transfer belts) that contain semi-conductive polyimide, polyamide imide, polycarbonate, polyarylate, polyester, rubber, and the like. The intermediate transfer body may have a belt shape or a drum shape.

Next, operation for forming an image by using the image forming apparatus 100 is described.

First, the surface 72 of the rotating electrophotographic photoreceptor 7 is charged by the charging device 8. The exposing device 9 exposes the surface 72 of the charged electrophotographic photoreceptor 7 on the basis of the image information. As a result, an electrostatic latent image corresponding to the image information is formed on the electrophotographic photoreceptor 7. In the developing device 11, the electrostatic latent image on the surface 72 of the electrophotographic photoreceptor 7 is developed by using a developer containing a toner that has toner particles. As a result, a toner image is formed on the surface 72 of the electrophotographic photoreceptor 7. The toner image on the surface 72 of the electrophotographic photoreceptor 7 is transferred to the intermediate transfer body 50. The toner image on the intermediate transfer body 50 is transferred onto a recording medium by using a second transfer device not illustrated in the drawing. The toner image on the recording medium is fixed by using a fixing device not illustrated in the drawing.

The toner particles remaining on the surface 72 of the electrophotographic photoreceptor 7 after the transfer of the toner image are intercepted by the intercepting member 151 of the intercepting device 15 and a toner reservoir is formed by the toner particles that have accumulated from the gap 157 to the surface 152. The toner reservoir scrubs the surface 72 of the electrophotographic photoreceptor 7 and corona products attached on the surface 72 of the electrophotographic photoreceptor 7 are removed.

Particles (for example, particles of the external additive) that have passed through the gap 157 are removed from the surface 72 of the electrophotographic photoreceptor 7 by the cleaning blade 131 of the cleaning device 13.

Figure 8:
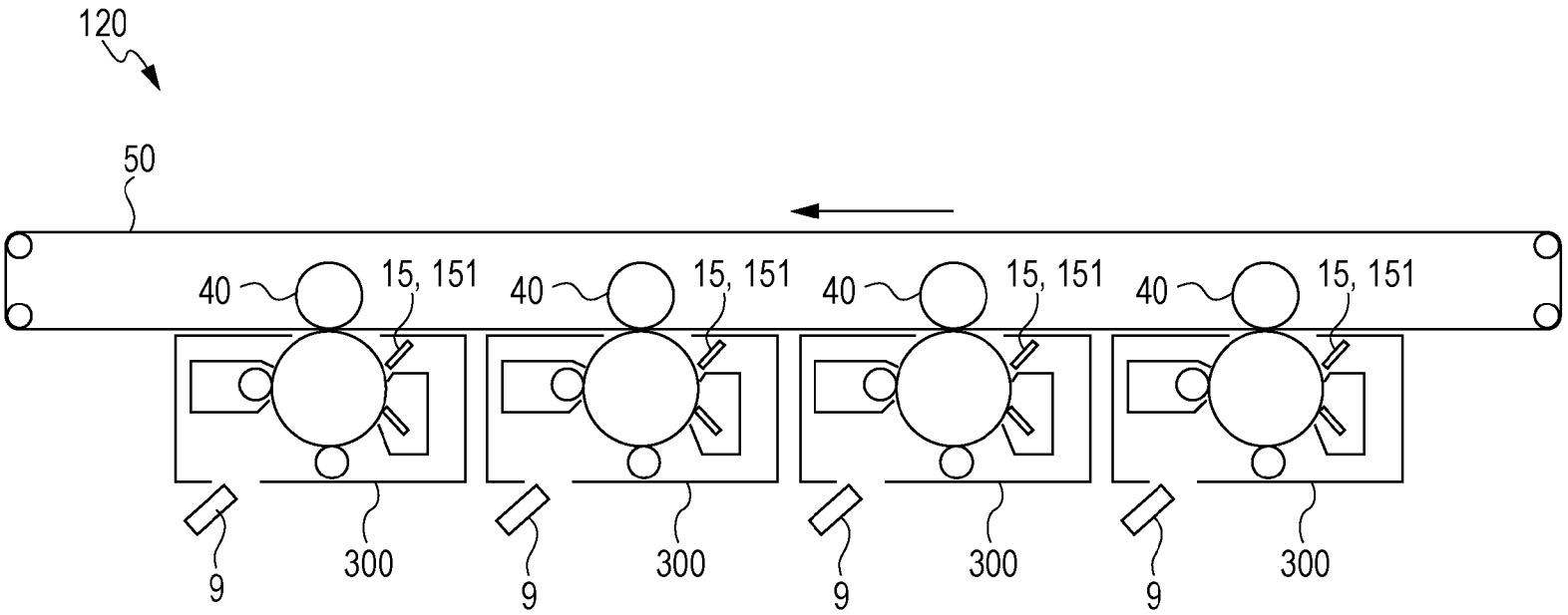
FIG. 8 is a schematic diagram illustrating another example of the image forming apparatus according to the exemplary embodiment.

FIG. 8 is a schematic diagram illustrating another example of the image forming apparatus according to the exemplary embodiment.

An image forming apparatus 120 illustrated in FIG. 8 is a tandem-system multicolor image forming apparatus equipped with four process cartridges 300. In the image forming apparatus 120, four process cartridges 300 are arranged side-by-side on the intermediate transfer body 50 and one electrophotographic photoreceptor is used for one color. The image forming apparatus 120 has a structure identical to the image forming apparatus 100 except for that image forming apparatus 120 has a tandem system.

The image forming apparatus 100 according to the exemplary embodiment is not limited to one having the structure described above. For example, a first charge erasing device that aligns polarity of the residual toner so as to facilitate removal of the toner with a cleaning brush may be provided near the electrophotographic photoreceptor and at a position downstream of the transfer device 40 in the rotation direction of the electrophotographic photoreceptor 7 and upstream of the cleaning device 13 in the rotating direction of the electrophotographic photoreceptor 7. Furthermore, a second charge erasing device that erases charges from the surface 72 of the electrophotographic photoreceptor 7 may be provided downstream of the cleaning device 13 in the rotation direction of the electrophotographic photoreceptor and upstream of the charging device 8 in the rotating direction of the electrophotographic photoreceptor.

The structure of the image forming apparatus 100 according to the exemplary embodiment is not limited by the above-described structures. For example, the image forming apparatus 100 may be a direct-transfer-type image forming apparatus configured to directly transfer a toner image formed on the electrophotographic photoreceptor 7 onto a recording medium.

EXAMPLES

The present invention will now be described through specific examples which do not limit the scope of the present invention. In the examples below, "parts" means parts by weight.

Fabrication of Electrophotographic Photoreceptor

Preparation and Fabrication of Silica Particles

To 100 parts by weight of untreated (hydrophilic) silica particles whose trade name is OX50 (produced by AEROSIL CO., LTD.), 30 parts by weight of a hydrophobing agent, namely, 1,1,1,3,3,3-hexamethyldisilazane (produced by Tokyo Chemical Industry Co., Ltd.) is added, and the reaction is carried out for 24 hours. Then filtering is conducted to obtain silica particles. These silica particles are assumed to silica particles (1). The condensation ratio of the silica particles (1) is 93%.

Fabrication of Undercoat Layer

Zinc oxide (average particle size: 70 nm, produced by Tayca Corporation, specific surface area: 15 $m^2/g$) in an amount of 100 parts by weight is mixed and stirred with 500 parts by weight of tetrahydrofuran, and 1.3 parts by weight of a silane coupling agent (KBM503 produced by Shin-Etsu Chemical Co., Ltd.) is added to the resulting mixture, followed by stirring for 2 hours. Then tetrahydrofuran is distilled away at a reduced pressure, and baking is conducted at 120° C. for 3 hours. As a result, zinc oxide surface-treated with a silane coupling agent is obtained.

The surface-treated zinc oxide (zinc oxide surface-treated with a silane coupling agent) in an amount of 110 parts by weight is mixed and stirred with 500 parts by weight of tetrahydrofuran. A solution prepared by dissolving 0.6 part by weight of alizarin in 50 parts by weight of tetrahydrofuran is added to the resulting mixture, followed by stirring at 50° C. for 5 hours. The alizarin-added zinc oxide is filtered out by vacuum filtration and dried at 60° C. at a reduced pressure. As a result, alizarin-added zinc oxide is obtained.

To 85 parts by weight of methyl ethyl ketone, 60 parts by weight of the alizarin-added zinc oxide, 13.5 parts by weight of a curing agent (blocked isocyanate, Sumidur 3175 produced by Sumitomo Bayer Urethane Co., Ltd.), and 15 parts by weight of butyral resin (S-LEC BM-1 produced by Sekisui Chemical Co., Ltd.) are added to prepare a mixture. Then this mixture in an amount of 38 parts by weight is mixed with 25 parts by weight of methyl ethyl ketone. The resulting mixture is dispersed for 2 hours in a sand mill using glass beads 1 mm in diameter to obtain a dispersion.

To the dispersion, 0.005 part by weight of dioctyltin dilaurate serving as a catalyst and 40 parts by weight of silicone resin particles (Tospearl 145 produced by Momentive Performance Materials Inc.) are added to obtain a coating solution for forming an undercoat layer. The coating solution is applied to an aluminum substrate having a diameter of 60 mm, a length of 357 mm, and a thickness of 1 mm by a dip coating technique and cured by drying at 170° C. for 40 minutes. As a result, an undercoat layer having a thickness of 19 μm is obtained.

Fabrication of Charge Generating Layer

A mixture containing 15 parts by weight of hydroxygallium phthalocyanine serving as a charge generating material and at least having diffraction peaks at Bragg angles (2θ±0.2°) of 7.3°, 16.0°, 24.9°, and 28.0° in an X-ray diffraction spectrum taken with a Cu Kα X-ray, 10 parts by weight of a vinyl chloride-vinyl acetate copolymer (VMCH produced by NUC Corporation) serving as a binder resin, and 200 parts by weight of n-butyl acetate is dispersed for 4 hours in a sand mill with glass beads having a diameter of 1 mm. To the resulting dispersion, 175 parts by weight of n-butyl acetate and 180 parts by weight of methyl ethyl ketone are added, followed by stirring. As a result, a charge generating layer-forming coating solution is obtained. The charge generating layer-forming coating solution is applied to the undercoat layer by dip coating, and dried at room temperature (25° C.). As a result, a charge generating layer having a thickness of 0.2 μm is obtained.

Fabrication of Charge Transporting Layer

To 50 parts by weight of the silica particles (1), 250 parts by weight of tetrahydrofuran is added. While maintaining the temperature of the resulting mixture to 20° C., 25 parts by weight of 4-(2,2-diphenylethyl)-4',4"-dimethyl-triphenylamine and 25 parts by weight of bisphenol Z-type polycarbonate resin (viscosity-average molecular weight: 30,000) serving as a binder resin are added. The resulting mixture is mixed under stirring for 12 hours. As a result, a coating solution for forming a charge transporting layer is obtained.

The coating solution for forming a charge transporting layer is applied to the charge generating layer and dried at 135° C. for 40 minutes to form a charge transporting layer having a thickness of 30 μm. Thus, an electrophotographic photoreceptor is obtained.

Through the steps described above, an organic photoreceptor (1) in which an undercoat layer, a charge generating layer, and a charge transporting layer are stacked in that order on an aluminum substrate is obtained.

Formation of Inorganic Protective Layer

Next, an inorganic protective layer formed of hydrogen-containing gallium oxide is formed on the surface of the organic photoreceptor (1). Formation of the inorganic protective layer is done by using a film forming device having the structure shown in FIGS. 6A and 6B.

First, the organic photoreceptor (1) is placed on the substrate supporting unit 213 inside the deposition chamber 210 and the interior of the deposition chamber 210 is vacuumed through the exhaust 211 until the pressure is 0.1 Pa.

Next, He-diluted 40% oxygen gas (flow rate: 1.6 sccm) and hydrogen gas (flow rate: 50 sccm) are introduced through the gas inlet duct 220 into the high-frequency discharge tube 221 equipped with the plate electrode 219 having a diameter of 85 mm. The high-frequency power supply unit 218 and a matching circuit (not illustrated in FIGS. 6A and 6B) are used to set the output of the 13.56 MHz radio wave to 150 W, and discharge is conducted from the plate electrode 219 while conducting matching with a tuner. The reflected wave is 0 W.

Next, trimethylgallium gas (flow rate: 1.9 sccm) is introduced from the shower nozzle 216 to the plasma diffusing unit 217 in the deposition chamber 210 through the gas inlet duct 215. The reaction pressure inside the deposition chamber 210 measured by a Baratron vacuum meter is 5.3 Pa.

Under such conditions, while the organic photoreceptor (1) is rotated at a rate of 500 rpm, film deposition is conducted for 68 minutes. As a result, an inorganic protective layer having a thickness of 1.5 μm is formed on the surface of the charge transporting layer of the organic photoreceptor (1).

Through the steps described above, an electrophotographic photoreceptor in which an undercoat layer, a charge generating layer, a charge transporting layer, and an inorganic protective layer are stacked in that order on a conductive substrate is obtained.

Preparation of Developer

Fabrication of Cyan (C) Toner Particles 1

Synthesis of Polyester Resin

Into a heat-dried three-necked flask, 124 parts by weight of ethylene glycol, 22.2 parts by weight of sodium dimethyl 5-sulfoisophthalate, 213 parts by weight of dimethyl sebacate, and 0.3 parts by weight of dibutyl tin oxide serving as a catalyst are placed. Then the air inside the flask is purged with nitrogen gas by reducing the pressure so as to create an inert atmosphere. The mixture is then mechanically mixed at 180° C. for 5 hours. The temperature is then slowly increased under a reduced pressure until 220° C. and the mixture is stirred for 4 hours. After the mixture becomes viscous, the mixture is air-cooled to stop the reaction. As a result, 220 parts by weight of a polyester resin is synthesized.

The weight-average molecular weight ($M_W$) of the obtained polyester resin measured by gel permeation chromatography (polystyrene equivalent) is 19,000 and the number-average molecular weight ($M_n$) is 5,800.

Preparation of Dispersions

Into 850 parts by weight of distilled water, 150 parts by weight of the obtained polyester resin is placed and the mixture is stirred by being heated to 80° C. with a homogenizer (ULTRA-TURRAX produced by IKA Japan). As a result, a resin particle dispersion is obtained.

Next, 250 parts by weight of a phthalocyanine pigment (PV FAST BLUE produced by Dainichiseika Color & Chemicals Mfg. Co., Ltd.), 20 parts by weight of an anionic surfactant (NEOGEN RK produced by DKS Co., Ltd.), and 700 parts by weight of ion exchange water are mixed to prepare a solution. The solution is dispersed with a homogenizer (ULTRA-TURRAX produced by IKA Japan). As a result, a coloring agent dispersion containing a dispersed coloring agent is obtained.

Next, 100 parts by weight of paraffin wax (HNP0190 produced by Nippon Seiro Co., Ltd., melting point: 85° C.), 5 parts by weight of a cationic surfactant (SANISOL B50 produced by Kao Corporation), and 240 parts by weight of ion exchange water are placed in a round stainless steel flask and dispersed for 10 minutes with a homogenizer (ULTRA-TURRAX T50 produced by IKA Japan). The resulting dispersion is further dispersed with a pressure homogenizer. As a result, a releasing agent particle dispersion containing dispersed releasing agent particles having an average particle size of 550 nm is obtained.

Preparation of Aggregated Particles

Into a round stainless steel flask, 2400 parts by weight of the obtained resin particle dispersion, 100 parts by weight of the obtained coloring agent dispersion, 63 parts by weight of the obtained releasing agent particle dispersion, 6 parts by weight of aluminum sulfate (produced by Wako Pure Chemical Industries, Ltd.), and 100 parts by weight of ion exchange are placed. The pH of the resulting mixture is adjusted to 2.0 and then dispersing is conducted with a homogenizer (ULTRA-TURRAX T50 produced by IKA Japan). The resulting dispersion is heated in an oil bath for heating up to 60° C. under stirring and held under the same conditions until formation of aggregated particles having a volume-average particle size of 5 μm is confirmed.

The pH of the aggregated particle solution is 2.4. Thereto, an aqueous solution prepared by diluting sodium carbonate (produced by Wako Pure Chemical Industries, Ltd.) to a concentration of 0.5% by weight is gently added to the aggregated particle solution and the reaction products are filtered, thoroughly washed with ion exchange water, and dried in a vacuum drier. As a result, cyan toner particles 1 are obtained.

The cyan toner particles 1 have a volume-average particle size of 5.0 μm.

Preparation of Yellow (Y) Toner Particles 1

Yellow (Y) toner particles 1 are obtained as with the cyan toner particles 1 except that a yellow azo pigment is used instead of the phthalocyanine pigment.

Preparation of Magenta (M) Toner Particles 1

Magenta (M) toner particles 1 are obtained as with the cyan toner particles 1 except that a quinacridone pigment is used instead of the phthalocyanine pigment.

Preparation of Black (K) Toner Particles 1

Black (K) toner particles 1 are obtained as with the cyan toner particles 1 except that carbon black is used instead of the phthalocyanine pigment.

Fabrication of Toners 1

Into a 75 L Henschel mixer, 100 parts by weight of the toner particles 1 of one of four colors obtained as above and 0.5 parts by weight of hexamethyldisilazane-treated silica particles (volume-average particle size: 40 nm) serving as an external additive are placed. The mixture is then mixed for 10 minutes and screened through an air screen, Hi-Bolter 300 (produced by Toyo Hitec Co., Ltd.). The same procedure is conducted for all four colors. As a result, toners 1 of four colors are prepared.

Fabrication of Toners 2

Toner particles 2 of four colors are prepared as with the toner particles 1 except that in fabricating the aggregated particles, retention is performed until the accumulated average particle size measured through an optical microscope is 7.0 μm.

The toner particles 2 of each color have a volume-average particle size of 7.0 μm.

Then toners 2 are obtained as with the toners 1 except that the toner particles 2 are used instead of the toner particles 1.

Fabrication of Developer Set 1

A mixture prepared by adding 0.15 parts by weight of vinylidene fluoride and 1.35 parts by weight of a methacrylate-trifluoroethylene copolymer (copolymerization ratio is 80:20) to 100 parts by weight of ferrite cores is processed through a kneader so as to cover the ferrite cores having an average particle size of 50 μm with a resin (coating). As a result, a carrier is prepared.

In a 2 L V-blender, 8 parts by weight of the toner 1 of one of four colors and 100 parts by weight of the carrier are mixed and the same procedure is conducted for all four colors. As a result, developers of four colors are obtained.

The set of these four developers is assumed to be a developer set 1.

Fabrication of Developer Set 2

Developers of four colors are respectively prepared as in preparation of the developer set 1 except that the toners 2 of four colors are used instead of the toners 1 of four colors.

The set of the developers of four colors obtained as such is assumed to be a developer set 2.

Examples 1 to 5 and Comparative Examples 1 to 5

The electrophotographic photoreceptor obtained as above, the developer set ("Developer, Type" in Table) obtained as above, and an intercepting device that has an intercepting member (formed of polyurethane) are built into DocuCentre-VC7776 produced by Fuji Xerox Co., Ltd., to obtain a modified machine as indicated in Table.

The volume-average particle size of the toner particles contained in the developer set used in each example is indicated in Table ("Developer, Volume-average particle size (μm)" in Table).

The gap distance between the surface of the electrophotographic photoreceptor and the intercepting member is set according to Table ("Gap distance L" in Table). In the table, "-" means that the intercepting device is not installed.

The modified machine is equipped with a cleaning device that employs a cleaning blade system.

The following evaluation is conducted by using the modified machine. The results are indicated in Table.

Evaluation of Image Deletion

A halftone image having a density of 40% and covering the whole area is output on 10,000 sheets in a high-temperature, high-humidity environment of 29° C. and 80% RH. The machine is left in the same environment for 14 hours and a halftone image having a density of 40% and covering the whole area is output after elapse of the 14 hours so as to check if image deletion occurs.

The evaluation standard is as follows. The results are indicated in Table ("Image deletion" in Table).

Evaluation Standard

G1: No image deletion

G2: Image deletion not recognizable by naked eye occurs

G3: Image deletion is vaguely recognizable by naked eye

G4: Image deletion is clearly recognizable

Evaluation of Presence/Absence of Toner Reservoir

After evaluation of image deletion is conducted, whether a toner reservoir is formed between the electrophotographic photoreceptor and the intercepting member in the image forming apparatus is checked with naked eye. The results are indicated in Table. In Table, "Y" means that the toner reservoir is found and "N" means that the toner reservoir is not found by naked eye.

Evaluation of Machine Contamination

After conducting evaluation of image deletion, whether the front portion of the cartridge loading portion inside the image forming apparatus is contaminated is checked with naked eye. The results are indicated in Table. In Table, "Y" means that the contamination is observed and "N" means that the contamination is not observed by naked eye.

TABLE

| | Developer | | Intercepting | Evaluation | | |
|---|---|---|---|---|---|---|
| | Type | Volume-average particle size (μm) | member Gap distance L (μm) | Image deletion | Toner reservoir | Machine contamination |
| Example 1 | 1 | 5.0 | 2.0 | G1 | Y | N |
| Example 2 | 1 | 5.0 | 1.5 | G1 | Y | N |
| Example 3 | 1 | 5.0 | 4.0 | G1 | Y | N |
| Example 4 | 2 | 7.0 | 6.0 | G1 | Y | N |
| Example 5 | 2 | 7.0 | 3.5 | G1 | Y | N |
| Comparative Example 1 | 1 | 5.0 | 10.0 | G4 | N | N |
| Comparative Example 2 | 1 | 5.0 | 6.0 | G3 | N | N |
| Comparative Example 3 | 1 | 5.0 | — | G4 | N | N |
| Comparative Example 4 | 1 | 5.0 | 1.0 | G1 | Y | Y |
| Comparative Example 5 | 2 | 7.0 | 10.0 | G4 | N | N |

The results show that according to Examples, occurrence of image deletion in a high-temperature, high-humidity environment is suppressed compared to Comparative Examples 1, 2, and 5 in which the gap distance L is excessively large and Comparative Example 3 in which no intercepting member is provided. According to Examples, machine contamination is suppressed compared to Comparative Example 4 in which the gap distance L is excessively small.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor that includes a conductive substrate, a photosensitive layer on the conductive substrate, and an inorganic protective layer on the photosensitive layer, the inorganic protective layer constituting an outermost surface layer;

a charging device that charges a surface of the electrophotographic photoreceptor;

an electrostatic latent image forming device that forms an electrostatic latent image on the charged surface of the electrophotographic photoreceptor;

a developing device that houses a developer containing a toner having toner particles and develops the electrostatic latent image on the surface of the electrophotographic photoreceptor by using the developer so as to form a toner image;

a transfer device that transfers the toner image onto a surface of a recording medium;

a cleaning device that includes a cleaning blade and removes residual matters on the surface of the electrophotographic photoreceptor by bringing the cleaning blade into contact with the surface of the electrophotographic photoreceptor; and an intercepting device that includes an intercepting member separated from the electrophotographic photoreceptor by a gap so that a distance from the surface of the electrophotographic photoreceptor to the intercepting member is about from 0.3 to 0.9 (inclusive) times a volume-average particle size of the toner particles, the intercepting member being used to intercept residual toner particles at a position downstream of the transfer device and upstream of the cleaning device in a rotation direction of the electrophotographic photoreceptor, the residual toner particles remaining on the surface of the electrophotographic photoreceptor after the transfer of the toner image.

2. The image forming apparatus according to claim 1, wherein the distance from the surface of the electrophotographic photoreceptor to the intercepting member is about from 0.4 to 0.8 (inclusive) times the volume-average particle size of the toner particles.

3. The image forming apparatus according to claim 1, wherein the distance from the surface of the electrophotographic photoreceptor to the intercepting member is about from 0.5 to 0.7 (inclusive) times the volume-average particle size of the toner particles.

4. The image forming apparatus according to claim 1, wherein the inorganic protective layer contains gallium and oxygen.

5. The image forming apparatus according to claim 1, wherein the photosensitive layer includes a charge transporting layer and the charge transporting layer contains inorganic particles.

6. The image forming apparatus according to claim 5, wherein the inorganic particles are silica particles.

7. The image forming apparatus according to claim 1, wherein the intercepting member is arranged such that a surface thereof that intercepts the residual toner particles faces upward in a direction of gravitational force.

8. The image forming apparatus according to claim 1, wherein the intercepting member is a stationary member.

* * * * *